US006116132A

United States Patent [19]

Kamijo

[11] Patent Number: 6,116,132

[45] **Date of Patent: *Sep. 12, 2000**

[54] CUTTER, METHOD OF MAKING THE SAME AND APPARATUS FOR SHAPING AND CUTTING TAPE END

[75] Inventor: Noriyuki Kamijo, Suwa, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/626,244

[22] Filed: Mar. 29, 1996

[30] Foreign Application Priority Data

Mar. 31, 1995 [JP] Japan ..... 7-100554
Feb. 20, 1996 [JP] Japan ..... 8-056759

[51] Int. Cl.[7] ..... B26B 1/01

[52] U.S. Cl. ..... 83/599; 83/602; 83/694; 83/695

[58] Field of Search ..... 83/602, 684, 598, 83/599, 694, 695; 30/29

[56] References Cited

U.S. PATENT DOCUMENTS

| | | | |
|---|---|---|---|
| 1,125,577 | 1/1915 | Manypenny | 30/29 |
| 1,467,806 | 9/1923 | Naujoks et al. . | |
| 1,489,097 | 4/1924 | Nichols | 83/602 |
| 2,473,073 | 6/1949 | Rembold . | |
| 2,791,133 | 5/1957 | Hooe . | |
| 3,091,318 | 5/1963 | Carboni . | |
| 3,237,494 | 3/1966 | Norvelle . | |
| 3,299,505 | 1/1967 | Pionek | 30/29 |
| 3,738,213 | 6/1973 | Fairbanks | 83/602 |
| 4,539,880 | 9/1985 | Barber et al. . | |
| 4,644,649 | 2/1987 | Seaman et al. . | |
| 5,117,719 | 6/1992 | Tagaki et al. | 83/640 |

FOREIGN PATENT DOCUMENTS

| | | |
|---|---|---|
| 33 43 370 A1 | 11/1983 | Denmark . |
| 0 458 225 A1 | 5/1991 | European Pat. Off. . |
| 0 636 562 A1 | 6/1994 | European Pat. Off. . |
| 2 516 845 | 11/1981 | France . |
| 4-22654 | 1/1992 | Japan . |
| 839993 | 6/1960 | United Kingdom . |

*Primary Examiner*—Kenneth E. Peterson
*Attorney, Agent, or Firm*—Hogan & Hartson LLP

[57] ABSTRACT

A cutter for cutting a laminated sheet such as tapes or the like or for shaping or chamfering tape end into various rounded configurations, a method of making such a cutter and an apparatus for shaping and cutting tape end. A sheet metal is worked to form integrally stationary and movable cutting blades which are connected to each other through a pair of connectors. A gap is formed between a stationary cutting edge of the stationary cutting blade and a movable cutting edge of the movable cutting blade. When a resistance force is exerted between the stationary and movable cutting blades on cutting self-adhesive tape with release paper, the resisting force is counteracted by a tensile strength in the connectors and a buckling strength in flexible portions such that the proper gap between the stationary and movable cutting edges will not be changed by the resisting force.

16 Claims, 24 Drawing Sheets

CUTTER, METHOD OF MAKING THE SAME AND APPARATUS FOR SHAPING AND CUTTING TAPE END

BACKGROUND OF THE INVENTION

1. Field of the Invention

The present invention relates to a cutter, a method of making a cutter and an apparatus for shaping and cutting the end of a tape.

2. Description of the Related Art

For such a purpose of simplifying the operations of applying sheet-like members, a laminated sheet has recently been used in various applications. The laminated sheet includes a self-adhesive sheet which comprises a base sheet, a pressure-sensitive adhesive applied onto the base sheet and a release paper disposed on the adhesive.

We have attempted to develop an electronic information processor known as a tape printing apparatus as shown in FIG. 1. A sheet having the aforementioned structure is severed into a tape having a width of 5 mm to 40 mm. The tape is coiled into a roll which is in turn disposed in a tape cartridge. The tape cartridge is received in the tape printing apparatus.

The tape is delivered out by a tape delivery mechanism. The necessary letters are printed on the substrate surface of the delivered tape by an operator through a keyboard. Thereafter, the delivered tape is cut away into the necessary length.

Plan and enlarged side views of the self-adhesive tape 5 with release paper used in such an apparatus are shown in FIGS. 2 and 3, respectively.

After release paper 9 has been stripped from the self-adhesive tape 5, its base sheet 7 having a pressure-sensitive adhesive 8 is applied to a requisite place to display letters printed thereon.

Such a display is more attractive than hand written letters. Since the tape can be applied to any requisite place without application of the any adhesive, an user will not be contaminated and can more rapidly perform the necessary operation. For such a usefulness, the self-adhesive tape with release paper is now being used over a wide range from business use to home use.

Such a self-adhesive tape 5 as shown in FIGS. 2 and 3 is linearly cut by a known cutter which is disposed adjacent to the tape delivery slit 4 of the tape printing apparatus 1.

When the self-adhesive tape 5 is linearly cut by the cutter, the cut tape has such a rectangular contour as shown in FIG. 2. Such a rectangular contour is not only hard but also uniform in appearance. It has been frequently desired that the cut tape have a soft appearance.

When the self-adhesive tape is cut into a rectangular configuration and is applied to a member, the rectangular tape end is likely to be separated from the member at its corners.

To avoid such a problem, one approach may effectively be made so that the rectangular cut end of the self-adhesive tape 5 is chamfered or rounded as shown in FIG. 4.

Japanese Patent Application Laid-Open No. Hei 4-22654 discloses a cutter which has a shape formed into the configuration of the tape end to be cut, the cutter being pressed against the tape to cut the tape end into a desired configuration.

In such a structure, however, it is difficult to cut a part of the tape by utilizing a so-called shear angle like known scissors since the cutter is pressed against the tape to be cut. Moreover, since the tape end is at once cut through the whole width thereof, the pressing force must be substantially strong. Otherwise, the whole thickness of the tape end can not be cut through the whole width thereof. However, an unreasonable pressing force to the cutter is likely to raise a problem in durability.

These problems are promoted in cutting a laminated sheet such as the self-adhesive tape 5 rather than a simple sheet of paper, since the thickness of the laminated sheet is larger and the adhesive functions as a cushion.

Furthermore, many types of cutters must be provided for various widths of tape. A structure for selecting and driving one cutter will be complicated with an increased cost. It is further difficult to deal with variability in tape width. In such a case, the chamfered or rounded right- and left-hand corners in the cut tape end became unbalance, leading to an unsatisfactory appearance in the cut tape end.

SUMMARY OF THE INVENTION

It is therefore an object of the present invention to solve the above problems and to provide a cutter which can efficiently cut a sheet such as self-adhesive tape with release paper with reduced load and cost in an automatic manner, a method of making such a cutter and an apparatus for shaping and cutting the end of the tape.

To this end, the present invention provides a cutter comprising:

- a stationary cutting blade having at least one stationary cutting edge;
- a movable cutting blade having at least one movable cutting edge which moves along a locus including a position opposed to the stationary cutting edge; and
- a pair of connecting means for connecting the stationary cutting blade with the movable cutting blade, the pair of connecting means having flexible means for flexibly supporting the movable cutting blade relative to the stationary cutting blade;
- wherein a closed loop is formed by the stationary and movable cutting blades and the pair of connecting means.

Since a member to be cut is cut by the stationary and movable cutting blades connected through a pair of connecting means in a closed loop according to the present invention, a cutting stress can be counteracted by the resistance force of the closed loop. Thus, the cutter can be of a simplified structure with an increased rigidity.

Since the stationary and movable cutting blades are formed by the flat sheet members, the cutter can be more inexpensively manufactured.

Since the stationary and movable cutting edges are located opposed to each other on the plane, the cutter can be reduced in thickness and more compactly formed.

Since the member to be cut is sandwiched and cut between the stationary and movable cutting edges located opposed to each other on the plane, the cutting can be more efficiently made with a reduced load than the case where the cutter is pressed against the tape. Furthermore, means for driving the movable cutting blade may be lower in output and smaller in size. The cutter can be more compactly and inexpensively produced.

It is preferable that the stationary cutting blade includes a base portion to be fixed to an apparatus body and a free end portion having the stationary cutting edge. Moreover, it is also preferable that the pair of connecting means extend in a direction perpendicular to a cross direction of the base portion of the stationary cutting blade.

Thus, the connecting means can be disposed parallel to the direction of a tensile stress acting on the pair of connecting means due to the cutting resistance force to improve the cutter strength.

It is preferable that the pair of connecting means have tensile strength which counteracts tensile stress which acts on the pair of connecting means on cutting operation. It is further preferable that the stationary cutting blade has buckling strength which counteracts buckling stress which acts on the stationary cutting blade on cutting operation.

Since the pair of connecting means can counteract the cutting resistance force through the tensile strength when the member to be cut is cut, the strength can be sufficient even if the flexible means formed on the pair of connecting means is flexible. As a result, the cutting can be efficiently made with a reduced load. The drive means can be reduced in output and size. Thus, the cutter can be produced with reduced cost and compactness. Although the stationary cutting blade can counteract the cutting resistance force with the buckling strength, the stationary cutting blade will not be deformed.

It is further preferable that the flexible means has a swing center on the side of the stationary cutting blade, rather than a cutting position between the stationary cutting edge and the movable cutting edge.

Thus, a swing locus of the movable cutting edge is positioned most remote from the central point in the direction of thickness of the movable cutting edge. Therefore, the movable cutting edge will not hit into the stationary cutting edge when the movable cutting edge swings. This avoids such a malfunction as being provided by any interference between the stationary and movable cutting edges. In addition, the cutting can be more efficiently made with a more reduced load.

It is further preferable that the pair of connecting means comprises:

a pair of first connecting means having one end and another end, the one end being connected to the base portion of the stationary cutting blade; and second connecting means for connecting the another end of the pair of first connecting means;

wherein a pair of the flexible means are disposed inside of the pair of first connecting means substantially parallel to the pair of first connecting means, the flexible means being connected to the second connecting means and the movable cutting blade.

Thus, the tensile setrength in the pair of first connecting means and the buckling strength in the flexible means can be produced for providing a strength sufficient to counteract the cutting resistance force.

It is further preferable that the flexible portions have a swing center on the side of the movable cutting blade, rather than a cutting position between the stationary cutting edge and the movable cutting edge.

Thus, the flexible means can have its sufficient stroke.

It is further preferable that each of the stationary and movable cutting edges has a relief angle for avoiding a swing locus of the movable cutting edge.

Thus, even if the swing locus of the movable cutting edge interferes with the stationary cutting edge, the interference can be reduced by setting the relief angle. As a result, a malfunction caused by the interference can be avoided and the cutting can be efficiently made with a reduced load.

It is further preferable that the stationary cutting edge and the movable cutting edge cut a member which is self-adhesive tape with release paper, and that the movable cutting blade is disposed at a position facing the self-adhesive tape and the stationary cutting blade is disposed at a position facing the release paper.

Thus, the base sheet of the self-adhesive tape can be prevented from producing bowing or burrs on cutting. Further, the base sheet of the self-adhesive tape can provide a better appearance to improve the quality. In addition, the release paper can be more easily stripped since bowing or burrs are produced on the side of release paper.

It is further preferable that at least one of the stationary and movable cutting edges is inclined relative to the respective planes to have different endwise heights in the direction of blade width.

Such an arrangement can form a so-called shear angle. As a result, the cutting can be more efficiently made with a more reduced load, contrary to the case where the cutter is pressed against the tape.

It is further preferable that at least one of the movable cutting blade, flexible means and stationary cutting blade is bent to provide a first gap between the stationary and movable cutting edges, and that a bending position for providing the first gap is different from a swing center of the flexible means for swinging the movable cutting blade.

By preventing the bending position and the swing center line from being identical, the movable cutting edge can swing while maintaining the first gap, resulting in a better cutting quality.

It is further preferable that a second gap or overlap between the stationary and movable cutting edges is set between −10 $\mu$m and 50 $\mu$m, the second gap or overlap being created on a cutting operation when the movable cutting edge moves to a position opposed to the stationary cutting edge. More preferably, the second gap or overlap is set between −5 $\mu$m and 10 $\mu$m.

When the second gap or overlap is provided within said range, the movable cutting edge can reliably pass by the stationary cutting edge. This ensures a reliable cutting quality. It is intended herein that the minus (−) symbol indicates an overlap between the stationary and movable cutting edges while the plus (+) symbol represents a separation between the stationary and movable cutting edges.

It is further preferable that the stationary and movable cutting edges are curved to cut an end corner of a member to be cut into a round shape and has a substantially straight line located adjacent to a position in contact with intersecting two sides at the end corner of the member, the straight line being inclined with a small angle relative to the two sides.

Such an arrangement enables the member to be smoothly cut without a large difference in shape between the end corners even if the position of insertion of the member is slightly deviated from a proper position.

It is further preferable that a cutting edge portion formed by the stationary and movable cutting edges is divided into a plurality of sub-sections in the direction of blade width, the sub-sections being different from one another in shape.

Thus, a single cutter can cut the end of the member into any one of various shapes.

It is further preferable that each of the stationary and movable cutting edges is of a rectilinear configuration.

Thus, the member can be rectilinearly cut by the cutting edges in a reliable manner.

It is further preferable that the cutter of the present invention further comprises driving means for driving the movable cutting blade and driven means driven by the driving means, the driven means being disposed on part of the movable cutting blade between the pair of connecting means.

Thus, the movable cutting blade can be automatically driven by the driving means through the driven means that is disposed on part of the movable cutting blade.

It is further preferable that the driven means is disposed at a position adjacent to the movable cutting edge.

Thus, the movable cutting blade can be automatically driven by the driving means with a reduced driving force and in a reliable and stable manner.

According to another aspect of the present invention, a cutter comprises:

a stationary cutting blade having at least one stationary cutting edge;

a movable cutting blade having at least one movable cutting edge which moves along a locus including a position opposed to the stationary cutting edge;

a plurality of connecting means connected to the stationary cutting blade to form a first closed loop; and a plurality of flexible means connected to the movable cutting blade, wherein the flexible means, a part of the first closed loop, and the stationary cutting blade form a second closed loop inside the first closed loop.

The rigidity in the cutter can be increased by connecting the first loop with the second loop to share a part of the first loop with the second loop. This can also improve the strength in the connecting and flexible means.

The present invention futher provides a method of making a cutter comprising the steps of:

(a) integrally forming outlines of stationary and movable cutting blades and a pair of connecting means connected thereto with a plate-like member;

(b) cutting the stationary and movable cutting blade to form a stationary cutting edge on the stationary cutting blade and a movable cutting edge on the movable cutting blade at a position opposed to the stationary cutting edge; and (c) forming a gap between the stationary and movable cutting edges.

According to the method, a flat sheet member can be used to form an integral combination of the stationary cutting blade, the movable cutting blade, and the pair of connecting means. In addition, the stationary and movable cutting edges can be formed by one and the same means through a single step. If one of the cutting edges is varied in shape, therefore, the shape of the other cutting edge may be varied by the same amount substantially in the same direction. The cutting edges of complicated configuration can be easily formed without any complicated adjustment and with a reduced cost.

By providing a proper gap between the stationary and movable cutting edges, a cutter which can cut a member with a more reduced load and good cutting quality can be produced.

It is preferable that the method further comprises a step of inclining at least one of the stationary and movable cutting edges to provide different endwise heights in a direction of blade width in order to form a shear angle.

By forming a shear angle, the cutter which can more efficiently cut a member with a more reduced load and good cutting quality can be easily produced.

It is further preferable that the step (c) include a step of bending at least one of the stationary and movable cutting blade.

Thus, the bending can easily form a proper gap between the stationary and movable cutting edges.

It is further preferable that the step (c) include a step of upsetting the pair of connecting means so as to increase the length of the pair of connecting means.

The upsetting can easily form a proper gap between the stationary and movable cutting edges.

It is further preferable that the step (c) is carried out immediately after the step (b) is performed and before the movable cutting edge is returned to its original state.

By carrying out necessary steps to form a gap before the movable cutting edge is returned to its original state, a proper gap can be formed without any interference. As a result, the cutting edges can be prevented from being damaged with easy formation of the proper gap.

It is further preferable that the step (a) include a step of separating the movable cutting blade from the pair of connecting means, and the method further comprising a step of connecting the movable cutting blade with the pair of connecting means with a connecting plate before the step (b).

By connecting the movable cutting blade with the pair of connecting means by a separate connecting plate, any deviation will not be created between the stationary and movable cutting blades, and the stationary and movable cutting blades of complicated configuration can be exactly formed.

It is further preferable that the step (b) include a wire cutting step or a laser cutting step.

The wire or laser cutting step can easily cut the member to be cut and form the proper gap between the stationary and movable cutting edges.

The present invention further provides an apparatus for shaping and cutting the end of the tape, characterized by shaping and cutting the corners of the tape end by the use of the cutter of the present invention as described above.

Such an apparatus can provide a reduced space in which the cutter is to be installed and also reliably shape and cut the tape end.

DETAILED DESCRIPTION OF THE PREFERRED EMBODIMENTS

The first embodiment of the present invention will be described in detail with reference to FIGS. 1 to 7B.

Figure 1:
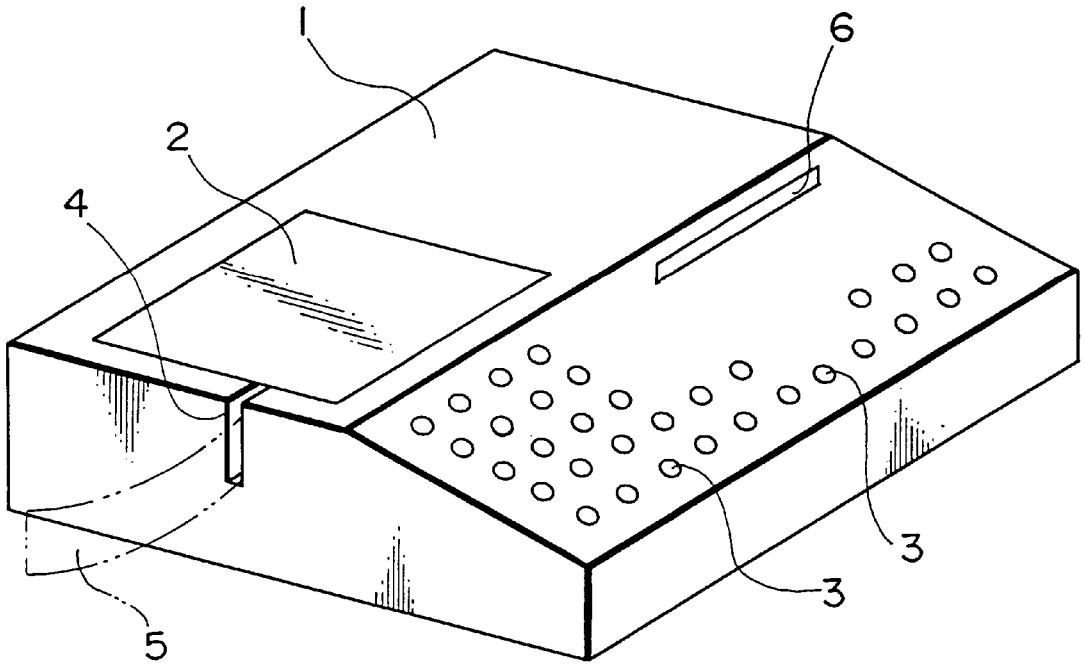
FIG. 1 is a perspective view of a tape printing apparatus including a cutter according to the present invention.

FIG. 1 is a perspective view of a tape printing apparatus having a cutter according to the first embodiment. In FIG. 1, 1 denotes a tape printing apparatus; 2 a tape cartridge holder; 3 keybuttons; 4 a tape delivery slit; 5 a self-adhesive tape with release paper and 6 a tape insertion slot through which the tape is inserted into the cutter according to the first embodiment.

Figure 2:
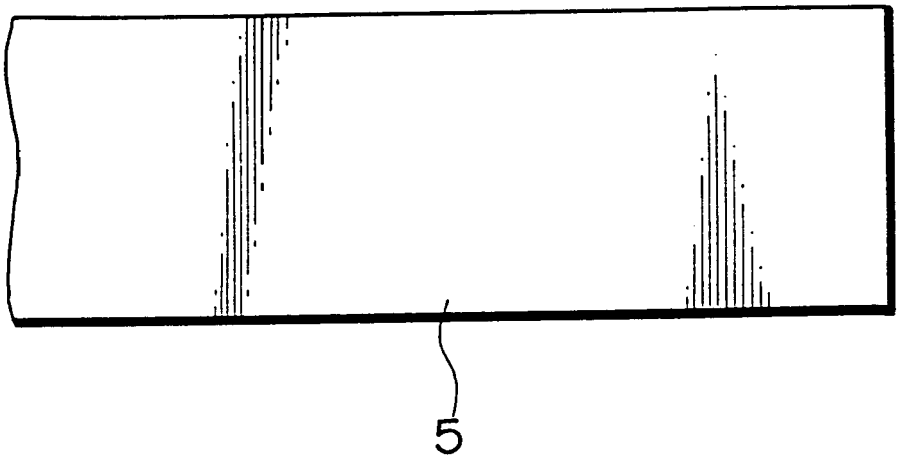
FIG. 2 is an enlarged plan view of the tape used in the tape printing apparatus of FIG. 1.

FIG. 2 is an enlarged plan view showing one end of the self-adhesive tape 5 which is rectilinearly cut after the self-adhesive tape 5 has been printed by the tape printing apparatus.

Figure 3:
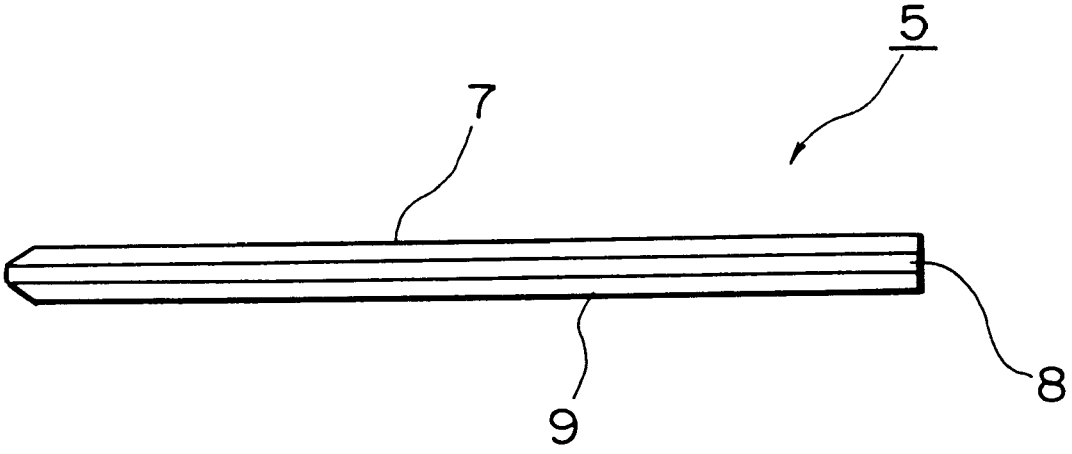
FIG. 3 is an enlarged side view of FIG. 2.

FIG. 3 is an enlarged side view of the self-adhesive tape 5 in FIG. 2, in which 7 designates a base sheet; 8 pressure-sensitive adhesive; and 9 release paper.

Figure 4:
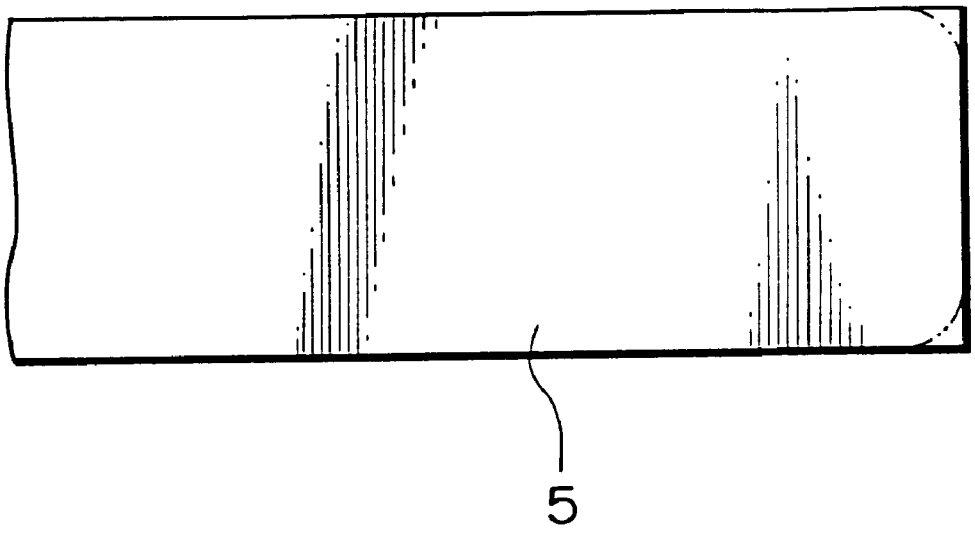
FIG. 4 is a plan view showing a tape end cut according to the present invention.

FIG. 4 is an enlarged plan view illustrating the self-adhesive tape 5 which is inserted into the tape insertion slot 6 of the tape printing apparatus 1 shown in FIG. 1 and then cut at its forward end into a rounded configuration by the cutter according to this embodiment.

The usage of the tape printing apparatus 1 will now be described.

First of all, a user puts a tape cartridge (not shown) in which a roll of the self-adhesive tape 5 is set into the tape cartridge holder 2 of the tape printing apparatus 1 shown in FIG. 1.

At this time, one end of the self-adhesive tape 5 must be positioned opposed to the tape delivery slot 4. Note that the self-adhesive tape 5 has a requisite width as shown in FIG. 2 and comprises the base sheet 7, the pressure-sensitive adhesive 8 applied thereonto and the release paper 9 used to protect the pressure-sensitive adhesive 8 until the self-adhesive tape 5 is to be used, as shown in FIG. 3. Adhesive strength between the release paper 9 and the pressure-sensitive adhesive 8 is smaller than that between the base sheet 7 and the pressure-sensitive adhesive 8. Normally, the release paper 9 has been treated by silicon or the like.

Then the keybuttons 3 on a keyboard are operated to select necessary letters. This generates signals which are processed by a known electronic circuit. Thus, the selected letters are printed on the surface of the base sheet 7 by known thermal transfer printing or the like while the self-adhesive tape 5 is being delivered at a given speed.

After all the necessary letters are printed, the self-adhesive tape 5 is stopped.

The self-adhesive tape 5 is then manually or automatically cut off into a necessary length along a straight line by a known cutter (not shown) which is disposed adjacent to the tape delivery slit 4. Thereafter, the self-adhesive tape is discharged through the tape delivery slit 4.

After the self-adhesive tape 5 has been cut off into the necessary length, it is manually inserted at one end into the tape insertion slot 6 shown in FIG. 1.

The self-adhesive tape 5 is then applied to a cutter 50 within the tape printing apparatus and located by the inner walls and others of the tape printing apparatatus 1, as shown in FIGS. 5, 6, 7A and 7B.

Figure 5:
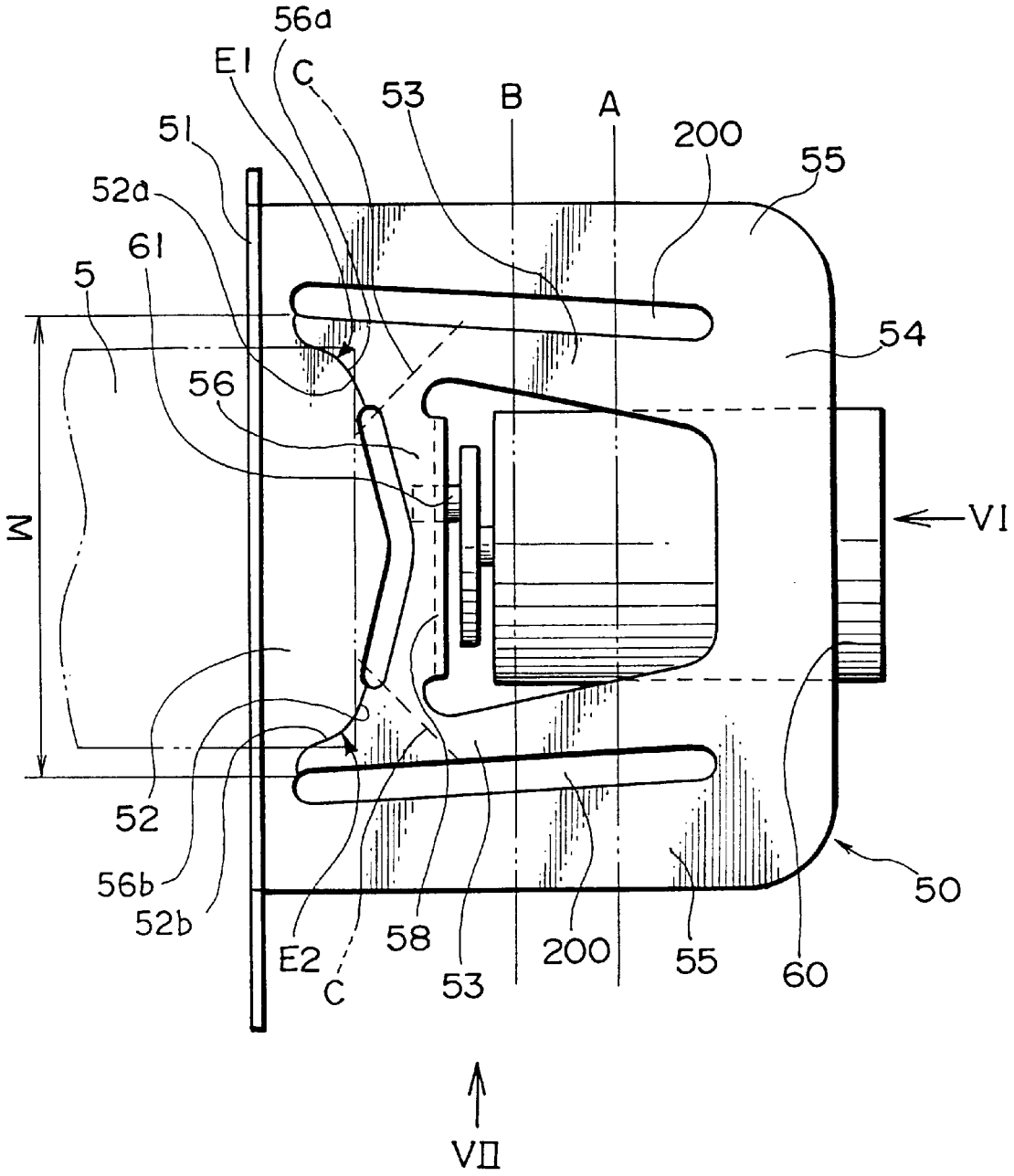
FIG. 5 is a plan view of a cutter according to the present invention.
Figure 6:
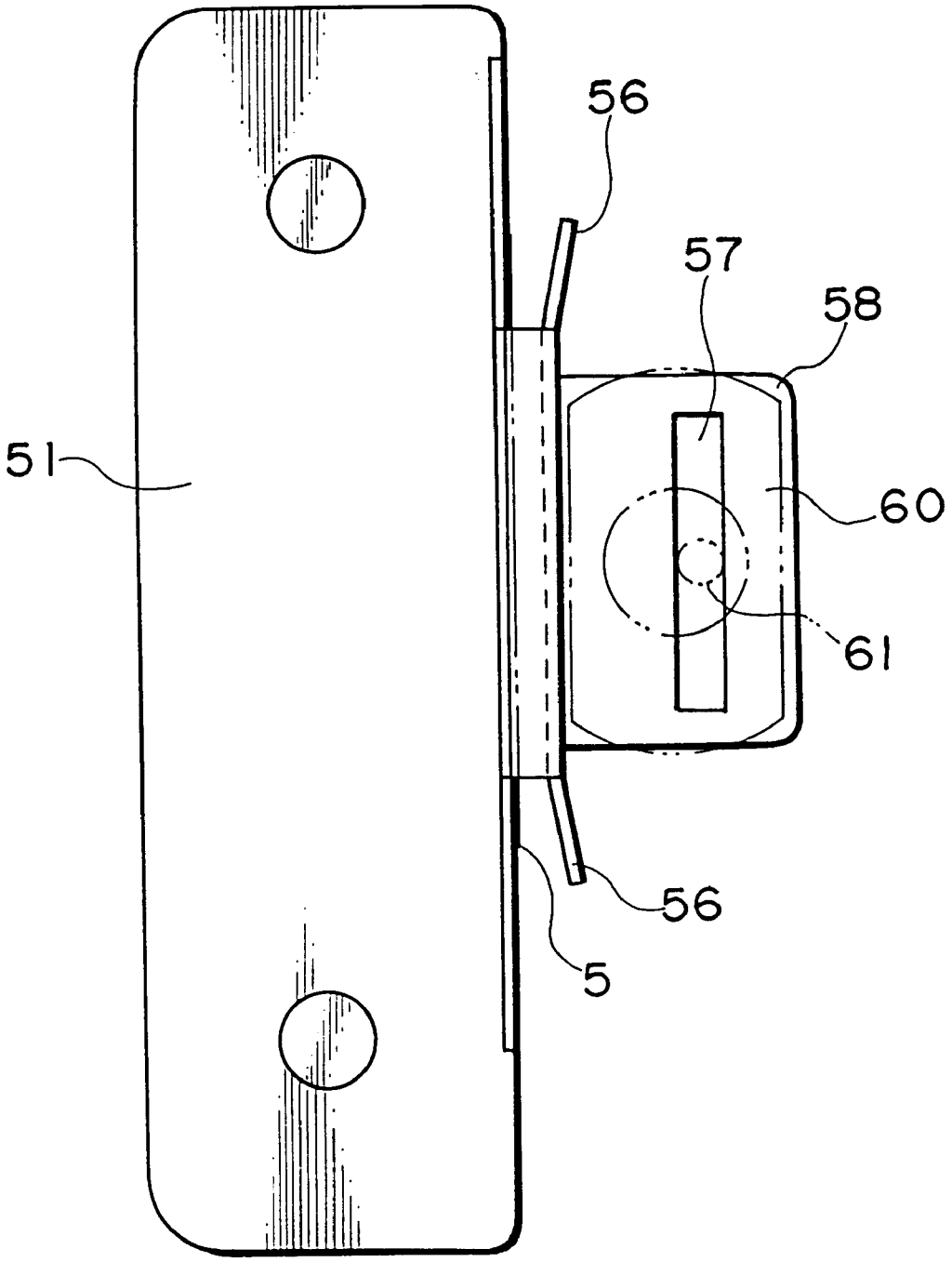
FIG. 6 is a right side view of a cutter according to the present invention.
Figure 7A:
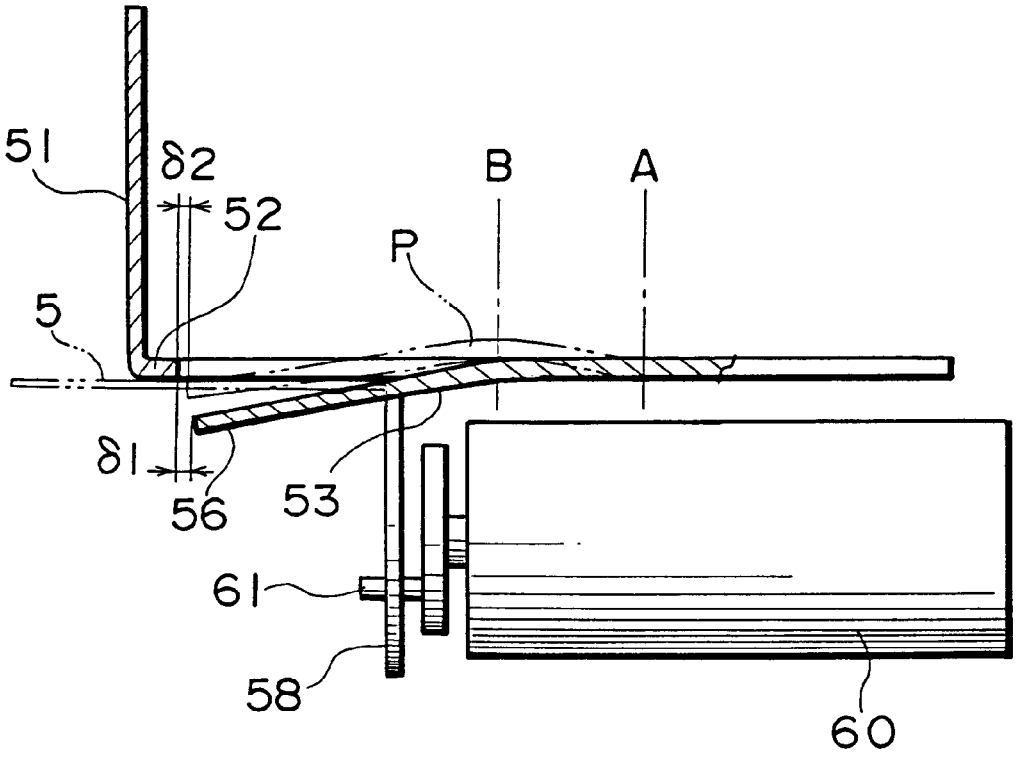
FIG. 7A is a front view of a cutter according to the present invention.

FIG. 5 is an enlarged plan view of the cutter which cuts the forward end of the self-adhesive tape 5 at its corners with a curvature; FIG. 6 is a side view of the same cutter as viewed from a direction of arrow VI in FIG. 5; and FIG. 7A is a view of the cutter as viewed from a direction of arrow VII in FIG. 5.

Although not illustrated, a known switch disposed within the tape printing apparatus 1 is actuated by the forward end of the inserted self-adhesive tape 5 to rotate a motor 60 which is disposed below the cutter 50.

The motor 60 has a shaft including an eccentric pin 61 fixedly mounted thereon. The eccentric pin 61 engages into a slot 57 which is formed in a bent portion 58 bent downward from the movable cutting blade 56 in the cutter 50, as shown in FIGS. 5, 6, 7A and 7B.

As shown, the cutter 50 is fastened on the inner wall of the tape printing apparatus 1 at an upstanding portion 51 by screw means.

The cutter 50 also includes a stationary cutting blade 52 located adjacent to the movable cutting blade 56, these blades being formed by cutting a part of a sheet metal. The stationary cutting blade 52 has stationary cutting edges 52*a* and 52*b*, and the movable cutting blade 56 has movable cutting edges 56*a* and 56*b*. The stationary cutting edge 52*a* and movable cutting edge 56*a* constitute a cutting edge portion E1, and the stationary cutting edge 52*b* and movable cutting edge 56*b* constitute a cutting edge portion E2. More particularly, the cutter 50 is defined by the stationary cutting blade 52 extending from the upstanding portion 51 at a right angle, first connecting portions 55 disposed on outer sides of the cutting edge portions E1 and E2 and extending substantially perpendicularly to the cross direction of the upstanding portion 51, second connecting portion 54 which connects the end of the first connecting portions 55, flexible portions 53 extending from the second connecting portion 54 toward the stationary cutting blade 52 and the movable cutting blade 56 connected to the flexible portions 53 and disposed adjacent to the stationary cutting blade 52.

The flexible portions 53 are flexible due to slits 200. Each of the slits 200 is formed between the flexible portion 53 and one of the first connecting portions 55, as shown in FIG. 5.

When the self-adhesive tape 5 is inserted into the tape printing apparatus 1 to initiate the motor 60, the eccentric pin 61 is rotated about the shaft of the motor 60. Thus, the movable cutting blade 56 is vertically moved relative to the plane of the cutter 50.

Although the eccentric pin 61 has been illustrated and described as to being mounted directly on the shaft of the motor 60, the eccentric pin 61 may be mounted through any one of reduction gears, lever type reduction devices and the like known in the art such that the speed of the vertical movement or the force moving the movable cutting blade 56 will be optimized.

In this embodiment, cutting edge portions E1 and E2 in the cutter 50 have curvature as shown in FIG. 5. The central portion between the cutting edge portions E1 and E2 is formed into a narrow opening such that the portion other than the corners of the self-adhesive tape will not be cut off.

As shown in FIG. 7A, when the cutting operations are not performed, the movable cutting edge 56*a* is disposed adjacent to the stationary cutting edge 52*a* to provide a first gap δ1 therebetween. As shown in FIG. 7A, the movable cutting blade 56 is slightly bent downward relative to the stationary cutting blade 52 such that the cut end of the self-adhesive tape 5 can be inserted into between the stationary and movable cutting blades 52 and 56.

When the cutting operations are performed, the movable cutting edge 56*a* moves to face the stationary cutting edge 52*a*, as shown by the broken line in FIG. 7A. In this time, there is a second gap or overlap δ2 between the stationary cutting edge 52*a* and the movable cutting edge 56*a*. The second gap or overlap depends on the thickness and hardness of the tape or sheet to be cut. When a sheet of plastic or paper is used in the tape printing apparatus or the like, the second gap or overlap is preferably between −10 μm and 50 μm and more preferably between −5 m and 10 μm. It is intended herein that the minus (−) symbol indicates an overlap between the stationary and movable cutting edges 52*a* and 56*a* while the plus (+) symbol represents a separation between the stationary and movable cutting edges 52*a* and 56*a*.

When the second gap or overlap δ2 is zero or negative value, the stationary cutting edges 52*a*, 52*b* and the movable cutting edges 56*a*, 56*b* will make an interference with each other. If the output of the motor 60 is larger, however, the self-adhesive tape 5 can be cut even if the second gap or overlap δ2 is −10 μm. If the second gap or overlap is less than −10 μm, it becomes difficult to cut the self-adhesive tape 5. In such a case, it is preferred that the second gap or overlap is equal to or larger than −5 μm taking account of the frictional resistance and interference at the cutting edge portion E, the load and current consumption of the motor 60 and the reduction of the machine size and so on.

If the second gap or overlap is larger than 50 μm, the self-adhesive tape 5 will be jammed in the second gap or overlap δ2 between the edge portions E1 and E2 when the movable cutting blade 56 is moved in the vertical direction. Thus, the self-adhesive tape 5 cannot be cut by the cutter.

This is because the cutting is influenced by the rigidity of the self-adhesive tape 5 and a cutting resistance (which is a resistance exerted onto the edge portions on the cutting). More particularly, the cutting resistance becomes larger than the rigidity of the self-adhesive tape 5 that tends to maintain the self-adhesive tape 5 in the normal plane. When the second gap or overlap is set to be within the proper range (between −10 μm and 50 μm, and more preferabley between −5 μm and 10 μm), however, the cutting resistance can be reduced. Therefore, the corners of the self-adhesive tape 5 can be clearly cut with curvature with lower loads and without production of the aforementioned problem.

Although the first embodiment has been described as to the rounded corners of the self-adhesive tape 5, the portion other than the corners in the end of the self-adhesive tape 5 may be cut as well as the corners. In addition, the self-adhesive tape 5 may be chamfered to provide the rectilinearly cut corners with a predetermined angle. The end of the self-adhesive tape 5 may be cut into a zigzagged or complicatedly curved configuration. These cutting operations may be provided by changing the shape of the edge portions.

These advantages may be provided by the special structure of the present invention. The special concept will now be described.

First of all, the first connecting portions 55 are disposed on outer sides of the cutting edge portions E1 and E2 in a direction substantially perpendicular to the cross direction of the upstanding portion 51. The first connecting portions 55 are connected at their end to the second connecting portion 54. The flexible portions 53 each having a spring constant smaller than that of the first connecting portions 55 are disposed to extend from the second connecting portion 54 toward the stationary cutting blade 52 in a direction substantially parallel to the first connecting portions 55. The forward end of the flexible portions 53 support the movable cutting blade 56 which faces the stationary cutting blade 52 through a gap. A part of the movable cutting blade 56 between the flexible portions 53 is bent (downward in this embodiment) to form a turned portion 58. As a driven portion of the movable cutting blade 56, the turned portion 58 is connected to the eccentric pin 61 of the motor 60 which is a drive means.

To obtain the gap between the stationary and movable cutting blades 52 and 56 by an extremely simple process, an entire configuration of the cutter including slits is formed by pressing a sheet metal. A portion to be formed into the edge portions E1 and E2 of the stationary and movable cutting blades 52 and 56 is then cut away with curvature and with substantially zero gap.

Thereafter, the flexible portions 53 are slightly bent downward around the line B in FIGS. 5 and 7A. This is preferably carried out by press working.

This bending operation provides the first gap δ1 between the stationary and movable cutting blades 52 and 56. FIG. 7A shows the configuration of the cutter in this stage. The movable cutting blade 56 moves upward from the state of FIG. 7A by the operation of the eccentric pin 61. When the movable cutting edge 56*a* faces the stationary cutting edge 52*a*, the second gap or overlap δ2 of a proper value (−10 μm to 50 μm, and more preferably −5 μm to 10 μm) is provided between the stationary and movable cutting edges 52*a* and 56*a*. The second gap or overlap δ2 of a proper value is also provided between the stationary and movable cutting edges 52*b* and 56*b*.

When the stationary and movable cutting blade 52 and 56 are formed by pressing a single sheet metal, the gap or overlap can be set to be a negative value (−10 μm to zero μm) according to the following reasons.

Figure 7B:
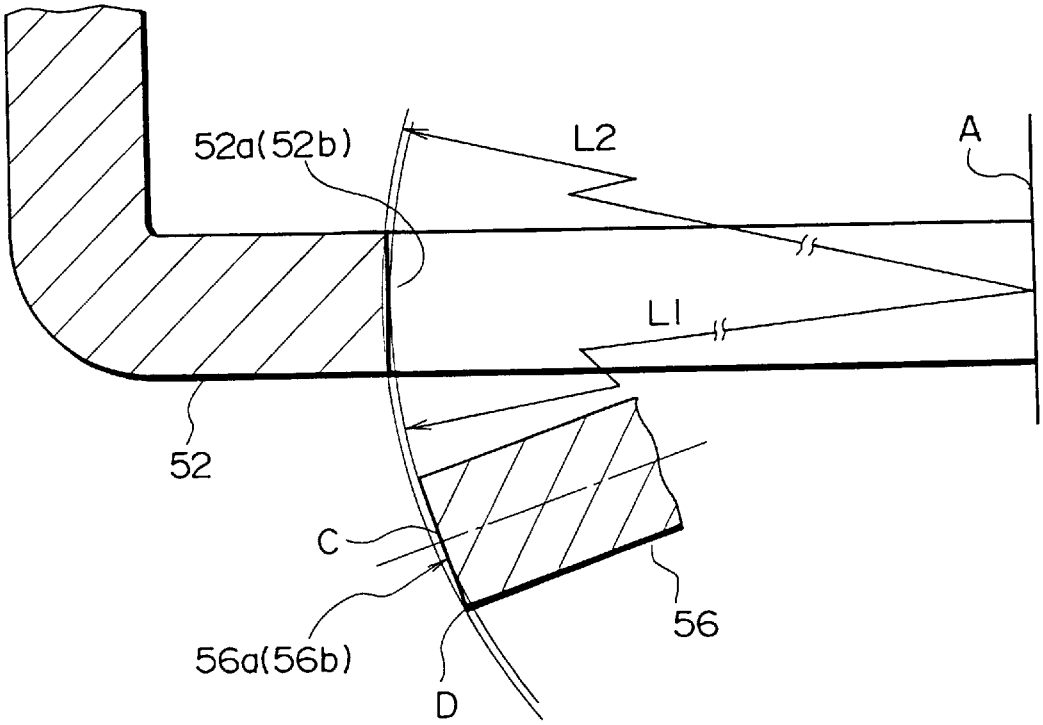
FIG. 7B is a schematic view illustrating a swing locus of the movable cutting edge.

As schematically shown in FIG. 7B, when a sheet metal is vertically cut to form the stationary cutting blade 52 and the movable cutting blade 56, a distance L2 from the swing center line A for the movable cutting blade 56 to the point D of the movable cutting edge 56*a* is longer than a distance L1 from the swing center line A to the middle point C of the movable cutting edge 56*a*.

The distance L1 is a radius of a locus which the middle point C will make when the middle point C swings around the swing center line A. The distance L2 is a radius of a locus which the point D will make when the point D swings around the swing center line A. When the point D faces the stationary cutting edge 52*a* or 52*b*, the second gap or overlap δ2 is a negative value because L2 is larger than L1.

If the sheet metal is to be cut slantly, the second gap or overlap of a negative value will be made by the overlap of the slantly cut portion.

In such an arrangement, when the self-adhesive tape 5 is inserted as shown in FIGS. 5, 6 and 7A, the movable cutting blade 56 is vertically moved by the action of the eccentric pin 61, and the flexible portions 53 swing around the swing center line A.

In this time, the first gap or overlap δ1 changes into the second gap δ2 by the swing of the flexible portions 53 around the swing center line A. The shift of the movable cutting blade 56 is normally several millimeters. If the distance between the movable cutting edges of the movable cutting blade 56 and the swing center line A is set to be larger than said shift to some degree, however, the change of the gap is not influential.

Thereafter, the flexible portions 53 are slightly bent downward around the line B in FIGS. 5 and 7A. This is preferably carried out by press working.

If the swing center line A is identical with the line B around which the flexible portions 53 are bent, however, the bending will be returned by the swing, and the first gap or overlap will be nulled. Such a situation is not preferable since an interference is likely to be created between the movable and stationary cutting edges.

It is therefore preferred that the line B is different from the swing center line A.

The advantages of the present invention may be similarly provided even if the line B is on the side of the stationary cutting blade 52 rather than the side of the movable cutting blade 56. Such an arrangement is preferred since the line B can be distinctly separated from the swing center line A.

Thus, the self-adhesive tape 5 inserted below the stationary cutting blade 52 can be cut between the stationary cutting edges 52*a*, 52*b* and the movable cutting edges 56*a*, 56*b* when the movable cutting blade 56 is moved in the upward direction. As a result, the corners of the self-adhesive tape 5 shown in FIGS. 4 and 5 can be cut with a curvature.

Thereafter, the self-adhesive tape 5 is drawn out from the tape insertion slot 6 of the tape printing apparatus 1. The opposite end of the tape is then similarly inserted into the tape insertion slot 6 and the corners of the end are cut away.

The self-adhesive tape 5 having the opposite cut and rounded end thereof will have a configuration softer than the prior art.

The first embodiment has been described as to the method in which the end of the self-adhesive tape 5 having its maximum cuttable width are cut by the cutter 50. A user can insert self-adhesive tape having its a width less than the maximum cuttable width into the tape insertion slot 6 while guiding the tape to one side of the tape insertion slot 6 for cutting one of its end corners with curvature.

Thus, the cutter 50 will be similarly actuated to cut one of the end corners with curvature.

Thereafter, the self-adhesive tape is moved sideways without drawing out, and the uncut corner of the self-adhesive tape is then cut with the same curvature.

If the cycle of rotation of the eccentric pin 61 is set at about 60 R.P.M.(revolution/minute), one end of the self-adhesive tape can be finished in about two seconds. The opposite ends of the self-adhesive tape can be finished in about ten seconds adding the re-insertion of the tape.

If the width of the cutter 50 is selected to be equal to the maximum width of the possible self-adhesive tape in such a manner, a single kind of cutter may be installed into the tape printing apparatus 1 to cut any self-adhesive tape having a width equal to or less than the maximum width. Consequently, the structure of the information processor such as the tape printing apparatus 1 can be simplified with a reduced manufacturing cost. In addition, a cumbersome operation in which several types of cutters are selectively used can be overcome to improve the utility.

The structure of the present invention has the following features other than the aforementioned feature.

The stationary cutting blade 52 is connected integrally to the movable cutting blade 56 through the first and second connecting portions 55 and 54.

A pair of such first connecting portions 55 are located on outer sides of the stationary cutting blade 52 and extend in a direction substantially perpendicular to the cross direction of the upstanding portion 51.

The movable cutting blade 56 is formed on the flexible portions 53 connecting to the second connecting portion 54. The flexible portions 53 are located substantially parallel to the first connecting portions 55.

The spring constant in the flexible portions 53 is set to be smaller than that of the first connecting portions 55 such that the cutter 50 can be actuated in the stable manner.

When the movable cutting blade 56 swings around the swing center line A in the flexible portions 53 in the above arrangement, such a movement is greatly influenced by the springiness of the flexible portions 53.

This is because the first connecting portions 55 have a large spring constant that will not influence the movement of the movable cutting blade 56.

Thus, the first connecting portions 55 will not swing even if the flexible portions 53 swing. Thus, the stable cutting can be maintained without substantial increase or decrease of the gap between the stationary and movable cutting blades 52 and 56.

If the first connecting portions 55 swing as in the flexible portions 53, the gap will be varied and becomes unstable.

Such a phenomenon degrades an cutting quality. In the worst case, the interference will be created between the cutting edge portions E1 adn E2 of the stationary and movable cutting blades 52 and 56. This interference makes the cutter inoperative. In addition, the cutting edge portions E1 and E2 will be damaged.

Therefore, the first connecting portions 55 are required to have a rigidity sufficient to counteract the swing of the flexible portions 53.

The first connecting portions 55 are disposed parallel to the flexible portions 53 and are arranged in a direction perpendicular to the cross direction of the upstanding portion 51. In this arrangement, when the self-adhesive tape 5 is cut, cutting resistance force acts on the gap between the stationary and movable cutting blades 52 and 56 to expand it in a direction normal to the cutting line.

When multi-layer tape including adhesive is cut, this cutting resistance force increases. It is because slippage is easily created between the respective layers on cutting, and under such slippage, the self-adhesive tape is likely to enter the gap without being cut.

To perform the desired and proper cutting operation, the first connecting portions 55 and flexible portions 53 should have their rigidity sufficient to maintain the gap within the proper range against the force in the normal direction.

If the first connecting portions 55 and flexible portions 53 are arranged to be perpendicular to the cross direction of the upstanding portion 51 which is a base portion of the stationary cutting blade 52, the cutting resistance force can be counteracted by the tensile strength of the first connecting portions 55 and the buckling strength of the flexible portions 53.

Generally, the tensile and buckling strengths can be set to be larger relative to the bending rigidity, so that they can sufficiently counteract the cutting resistance force in the normal direction. Thus, the gap can be ensured to improve the reliability on the cutting machine.

If the structure of the cutter is similar to the known scissors, the gap will be increased easily on cutting. As a result, the self-adhesive tape 5 will enter the increased gap such that it can not be cut.

This is because the flexible portions will have a flexibility in a direction perpendicular to the sheet plane of FIG. 5 as well as another flexibility in a direction parallel to the sheet plane of FIG. 5. To avoid such a problem, it may be considered that the regidity in the direction parallel to the sheet plane of FIG. 5 is increased. However, this also increases the regidity in the direction perpendicular to the sheet plane. Therefore, the drive of the movable cutting blade under such a situation is not desirable from the viewpoint of power consumption, size to be decreased and so on.

According to the present invention, thus, the cutting resisting force in the normal direction can be counteractd by a larger force. In addition, when the movable cutting blade 56 swings vertically as viewed in FIGS. 5 and 7A, only a slight force will be produced due to the length of the flexible portions 53 and the small bending in the direction of sheet thickness. Therefore, the cutting can be more reliably performed with a reduced load and with an increased regidity.

The first connecting portions 55 are located on outer sides of the cutting edge portions E1 and E2. If only one of the first connecting portions 55 is arranged, however, the one connecting portion will be bent by the cutting resistance force in the normal direction to increase the gap, as in scissors. This makes the cutting impossible.

When a pair of the first connecting portions 55 are disposed on outer sides of the stationary cutting blade 52, a closed loop in a parallelogram shape is formed by the first connecting portions 55, second connecting portion 54 and the stationary cutting blade 52, as shown in FIG. 5. The gap can be increased by the cutting resistance force in the normal direction only when the first connecting portions 55 are expanded against their tensile strength or when the flexible portions 53 are buckled against their buckling strength.

Since these tensile and buckling strengths can be easily set to be extremely large compared with the rigidity in the direction parallel to the sheet plane of FIG. 5 (bending strength in a cantilever) as described in connection to the known scissors, the advantages of the present invention can be provided.

In other words, the present invention is characterized in that the first connecting portions 55 and flexible portions 53 counteract the cutting resisting force in the normal direction through their tensile and buckling strengths, rather than the bending rigidity.

The movable cutting blade 56 is connected to the second connecting portion 54 through the base portion of the flexible portions 53. On the other hand, the free end portions of the flexible portions 53 are connected to each other through the movable cutting blade 56 which is reinforced with the bent portion 58.

These flexible portions 53 are disposed spaced away from each other in a plane as shown in FIG. 5.

The flexible portions 53, second connecting portion 54 and the movable cutting blade 56 define a closed loop of a parallelogram shape. An extremely large cutting force would be required to deform the parallelogram for changing the gap because the loop is closed. Thus, a force required to cut a normal sheet such as the self-adhesive tape 5 will not affect cutting quality. Therefore, the cutter can be provided with an extremely improved reliability.

As described, the present invention can cut only one end corner of tape at a time. In such a case, when one end corner of the self-adhesive tape 5 in FIG. 5 is being cut by the movable cutting edge 56*a*, the movable cutting edge 56*a* has a phase shift slightly delayed from that of the movable cutting edge 56*b* due to the cutting resistance.

This is not desirable since the parallelogram is deformed in the direction of sheet thickness. Since the cutter of the present invention includes such a parallelogram structure as described, however, it can be highly improved in strength and reliability, compared with such a cutter that the free end portions of the flexible portions 53 are not connected to each other through the movable cutting blade 56 having the bent portion 58.

Although the first embodiment has been described as to the closed loop configuration of a parallelogram shape, the present invention is not limited such a configuration but may be applied to any one of triangular, rectangular, polygonal, circular and other closed loop configurations with the similar advantages and without departing from the scope of the invention.

If the bent portion 58, a common driven portion for the movable cutting edges 56*a* and 56*b*, is engaged to the motor 60 through the the eccentric pin 61, the cutting edges 56*a* and 56*b* can be simultaneously driven by the motor 60 through the eccentric pin 61. A single drive means is only required by such an arrangement. This desirably reduces the manufacturing cost, decreases the size of the machine and saves the necessary energy.

The bent portion 58 as the driven portion is located at a position adjacent to the free end portions of the flexible portions 53 and opposed to the edge portions E1 and E2. The cutting resistance is created in the direction of sheet thickness of the cutter 50 when the movable cutting blade 56 swings in the substantially vertical direction to cut the self-adhesive tape 5. If the driven portion is located spaced away from the free end portions, the movable cutting blade 56 will be undesirably bent between the driven portion and the edge portions E1 and E2 to change the gap.

It is therefore preferred that the driven portion is disposed adjacent to the edge portions E1 and E2 of the movable cutting blade 56 and at the end of the free end portions, irrespectively of whether or not the bent portion 58 exists.

Although the first embodiment has been described as to the pair of first connecting portions 55 disposed on outer sides of the stationary cutting blade 52, the present invention is not limited to such a structure.

When the movable cutting blade 56 is moved upward under the action of the eccentric pin 61 and when the self-adhesive tape 5 is cut by sandwiching it between the stationary cutting blade 52 and the movable cutting blade 56, the self-adhesive tape 5 can be cut across the whole width thereof at the same time. In such a case, the movable cutting blade 56 or stationary cutting blade 52 will be subjected to a cutting resistance which is the product of a cutting resistance per unit length and the length to be cut. This is not desirable in strength and is disadvantageous for the necessary energy.

To overcome such a problem, the first embodiment is characterized in that the forward end of the movable cutting blade 56 are bent into such a configuration as shown in FIG. 6 around the lines C, C as shown in FIG. 5.

When the movable cutting blade 56 swings upward, therefore, the self-adhesive tape 5 will be gradually cut outwardly from the center of the tape width.

This bending of the forward end of the movable cutting blade 56 corresponds to a so-called shear angle in scissors. By providing such a shear angle, the self-adhesive tape 5 will not be cut across the whole width thereof at a time, compared with the aforementioned structure. This reduces the load on cutting with an improved efficiency.

The shear angle can be set by bending forward end portions of the movable cutting blade 56 downward (e.g., between 5 degrees and 30 degrees) around lines not parallel to the line B. Thus, the shear angle can be properly set without influence to the gap formed by bending the flexible portions around the line B.

Figure 8:
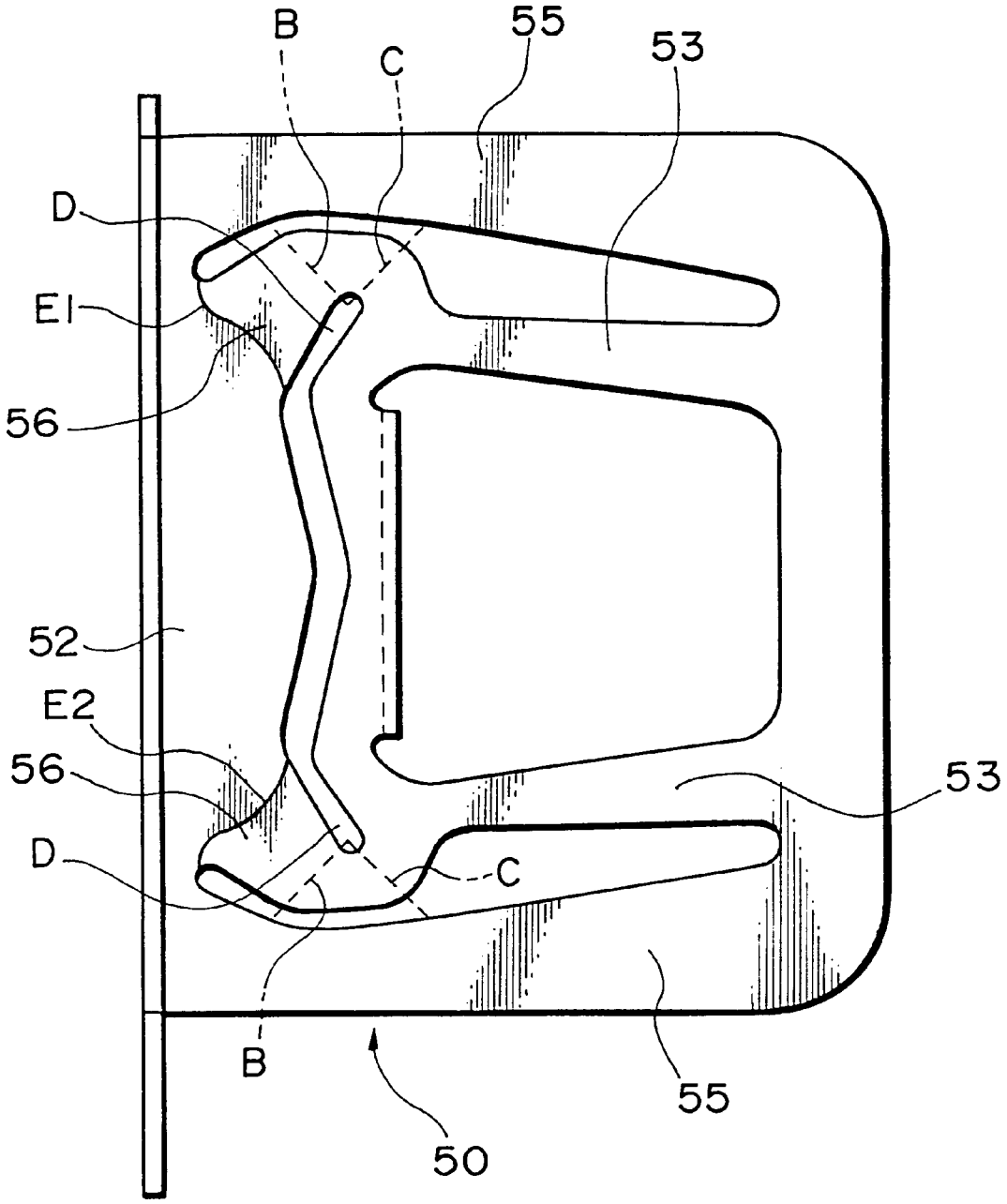
FIG. 8 is a plan view of a cutter constructed according to the second embodiment of the present invention.

Referring now to FIG. 8, the second embodiment of the present invention will be described.

FIG. 8 is a plan view showing another configuration of the cutter 50.

The second embodiment includes most parts similar to those of FIG. 5. Only differences will be described. In the second embodiment, slits D are formed between the movable cutting blades 56 and the flexible portions 53.

The movable cutting blades 56 are slightly bent downward (toward the back of the sheet plane of FIG. 8) around the lines B and C.

The lines B are substantially parallel to the cross direction of the edge portions E1 and E2 of the movable and stationary cutting blades 56 and 52.

The bending at the line B of FIG. 5 will vary the gap through the inclination of a fine line segment on the edge portions E1 and E2. On the contrary, the bending at the lines B of FIG. 8 can decrease the difference between said inclination angles. Thus, the gap or overlap at the edge portions E1 and E2 can be less changed. This can reduce variations of the gap in the mass-production and contribute to stabilization of the production.

At the same time, a shear angle can be provided by bending the sheet metal in the bottom of the respective slit D at the line C. The stationary cutting blade 52 is formed integrally with the movable cutting blades 56. The sheet metal is bent at these lines B and C at the same time when or after the sheet metal is cut at the edge portions E1 and E2. Thus, the aforementioned advantages due to the bending can be provided.

The second embodiment can be easily carried out by the pressing process even if some of the above components are taken in the second embodiment. If the gap is preponderantly managed, the sharpened and preferred cutting can be provided as mentioned hereinbefore.

Figure 13:
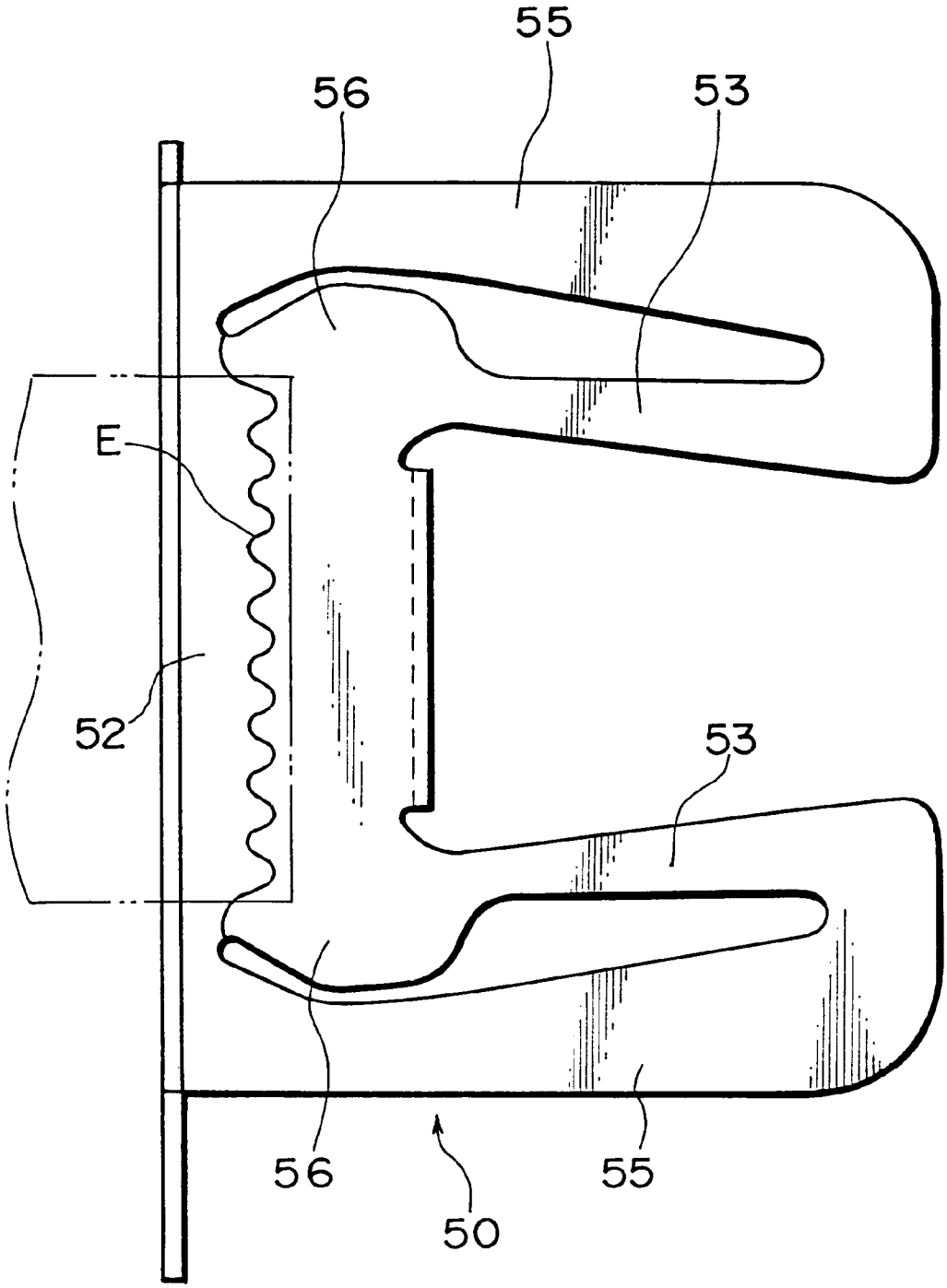
FIG. 13 is a plan view of a cutter according to the present invention, the cutter including a zigzag-shaped cutting blade.
Figure 14:
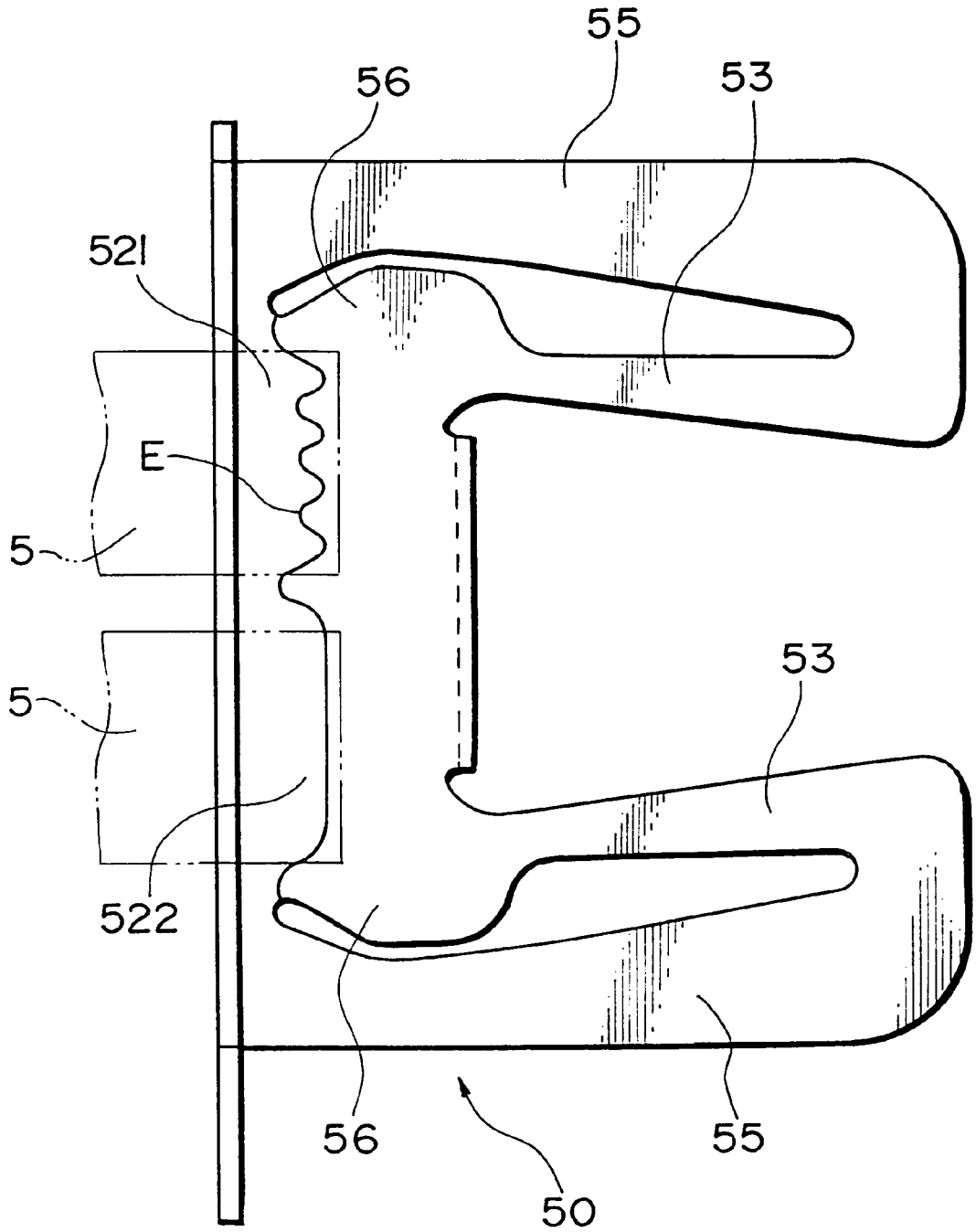
FIG. 14 is a plan view of a cutter having cutting blades with a plurality of different edges according to the present invention.

The cutter of the present invention does not require a blade grinding operation as in the conventional scissors and can greatly reduce its manufacturing cost. Even if the edge portions E1 and E2 are to be finished into a complicated configuration, for example, into the edge portions E having complicated configrations as shown in FIGS. 13 and 14 or even if the edge portion E is divided into a plurality of sections 521 and 522 as shown in FIG. 14 and a desired configuration of the cut end is selected by inserting the self-adhesive tape 5 into the corresponding port of a single cutter 50, the present invention can be similarly applied.

Even in such an arrangement, the configuration of the edge portions E can be determined by the same punch or die shape in the pressing and cutting step, as described. If one of the edge portions E of the stationary and movable cutting blade 52 and 56 has a slightly varying configuration, the other will also have the same variation substantially in the same direction.

If the gap or overlap has been ensured at the edge portions E, therefore, they will not be damaged through an interference therebetween. In addition, the drive can be smoothly performed with reduction of the interference.

The aforementioned cutter 50 of the present invention can be produced by the following method.

The stationary cutting blade 52 is formed integrally with the movable cutting blade 56 through the flexible portions. It is preferred that the bending at the upstanding portion 51 and other portions is carried out before the edge portions E are cut. This is because if the bending is performed after the cutting step, the configuration to be cut will be influenced by the bending step at a position nearer the positions E, the gap being varied.

The edge portions E is formed by processing the stationary and movable cutting blade 52 and 56 by the same means at a time.

Such a working may be made through the wire discharge, laser and so on that are well-known in the art, in addition to the aforementioned press working.

The pressing process will be omitted since it has been described hereinbefore. The wire discharge or laser working process may be controlled by the same program to work the edge portions E at the same time. Therefore, the wire discharge or laser working process can provide the same advantages as in the pressing process since the size of the gap or overlap can be maintained stable.

Although the wire discharge or laser working process raise a problem in that the producibility is slightly inferior to the pressing process, they can rather provide a cutting blade that is superior to the pressing process since it has no sagging.

Although the pressing process is superior to the wire discharge or laser working process in producibility and produce burrs in the cut sheet metal at the edge portions E, the pressing process can provide a better cutting quality by utilizing these burrs as cutting edges and by creating a proper amount of burr on the bottom face of the stationary cutting blade and the top faces of the movable cutting blade.

When these situations are totally considered, the pressing process is most preferable.

However, the wire discharge or laser working process is also preferable in that they can form the gap at the same time when the stationary and movable cutting blade are cut at the edge portions E.

In such a case, the bending at the lines B can be omitted to form the gap.

As described, the shear angle is preferably provided to improve the cutting quality.

The shear angle can be formed by bending at least one of the stationary and movable cutting blade through the pressing and bending process.

An applied example of the present invention will be described with reference to FIGS. 9 and 10 in which parts similar to those of the previous embodiments are not illustrated.

Figure 9:
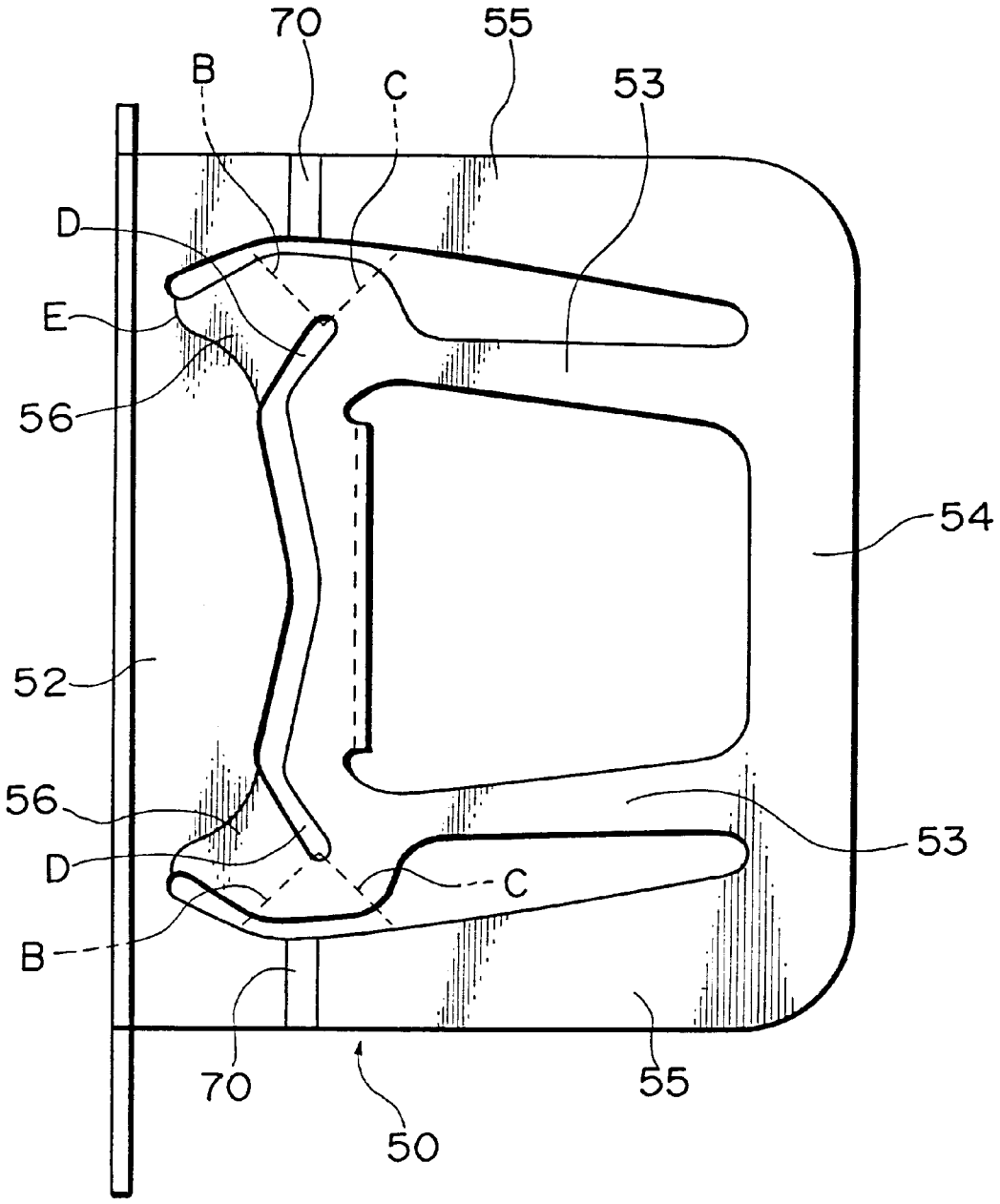
FIG. 9 is a plan view of a cutter constructed according to the fourth embodiment of the present invention.

In FIG. 9, the stationary and movable cutting blades 52 and 56 are formed from a single sheet metal and cut away from each other at the edge portions E thereof.

Figure 10:
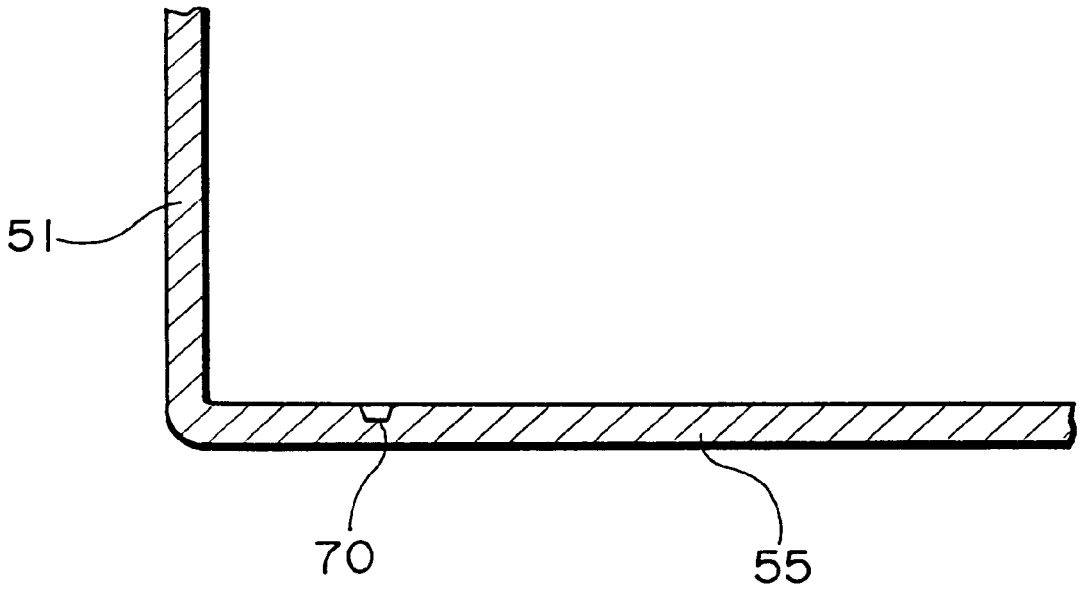
FIG. 10 is a partial sectional view of the cutter shown in FIG. 9.

Thereafter, parts of the first connecting portions 55 are slightly upset by the pressing process as shown by 70 in FIGS. 9 and 10.

The upsetting step slightly deforms the first connecting portions 55 in their longitudinal direction. Even if the gap between the first connecting portions 55 is equal to zero, the above deformation can maintain the gap proper to provide the aforementioned advantages.

The upsetting position may be carried out on any of the locations in the connection between the stationary and movable cutting blades 52 and 56 unless the most effective position to provide the configuration of the taken cutter 50 can be obtained.

The above upsetting step may be easily made through the well-known pressing step. This is superior in mass-production and advantageous in cost.

Figure 11:
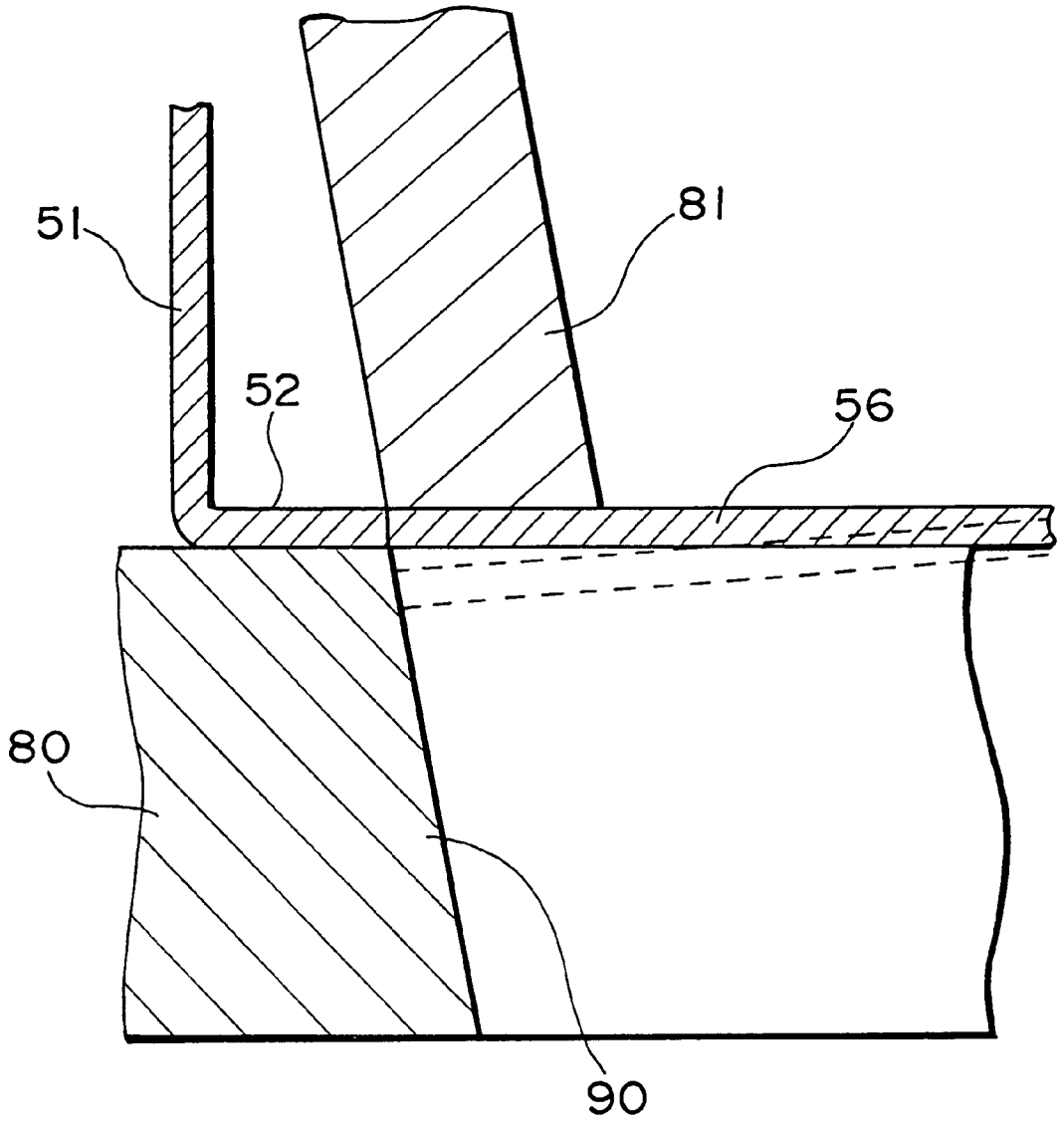
FIG. 11 is a sectional view of a further embodiment of the present invention.

FIG. 11 shows another applied example of the upsetting step. In FIG. 11, parts similar to those of the previous embodiments are not illustrated.

In FIG. 11, 52 denotes a stationary cutting blade; 56 a movable cutting blade; 80 a well-known die for defining a press die; and 81 a punch which is another die component.

As being well known, the edge portions E are cut by the punch 81 moving relative to the die 80 downward from the illustrated position without any gap between the integrally formed stationary and movable cutting blade 52 and 56 at the edge portions E.

At this time, the movable cutting blade 56 are flexed through the flexible portions to displace them into a state shown by the imaginary line. In such a case, the forward end of the cut movable cutting blade 56 slidably move along a tapered portion 90 formed in the die 90 to extend downward from the edge portions E. Thus, the movable cutting blade 56 will be slightly upset in the longitudinal direction of the flexible portions.

When a proper height is accomplished, the movable cutting blade 56 is again flexibly returned to the height of the stationary cutting blade 52 wherein the gap is maintained at the edge portions E. This provides one means of the components of the present invention.

On the other hand, the forward end of the movable cutting blade 56 are upset by the tapered portion 90 when the forward end of the movable cutting blade 56 slidably move on the tapered portion 90 of the die 80. This will produce shape burrs on the upper portions of the movable cutting blade 56 in the direction of sheet thickness. These shape burrs improve the cutting quality of the cutter. At the same time, the taper of the die 80 is transferred downward in the direction of sheet thickness such that the gap or overlap will be gradually increased relative to the configuration of the edge portions E in a direction extending downward from the upper corner of the sheet thickness. As a result, that upper corner can be sharpened even if no burr is produced on the forward end of the movable cutting blade 56. Furthermore, this reduces a risk of causing the lower corners of the movable cutting blade 56 in the direction of sheet thickness to interfere with the edge end of the stationary cutting blade. Such means further improves the reliability of the cutter.

Although the cutter and method of making the same according to the present invention have been described as to some components, a combination of these components can provide the advantages of the present invention rather than all the components in view of various factors such as the edge width W of the cutter, the material to be cut, the layered sheet structure and so on.

Each of the components in the present invention has an important feature.

The above embodiments have been described as to a single sheet metal from which the stationary cutting blade, movable cutting blade, connections and flexible portions are formed into an integral unit.

Figure 12:
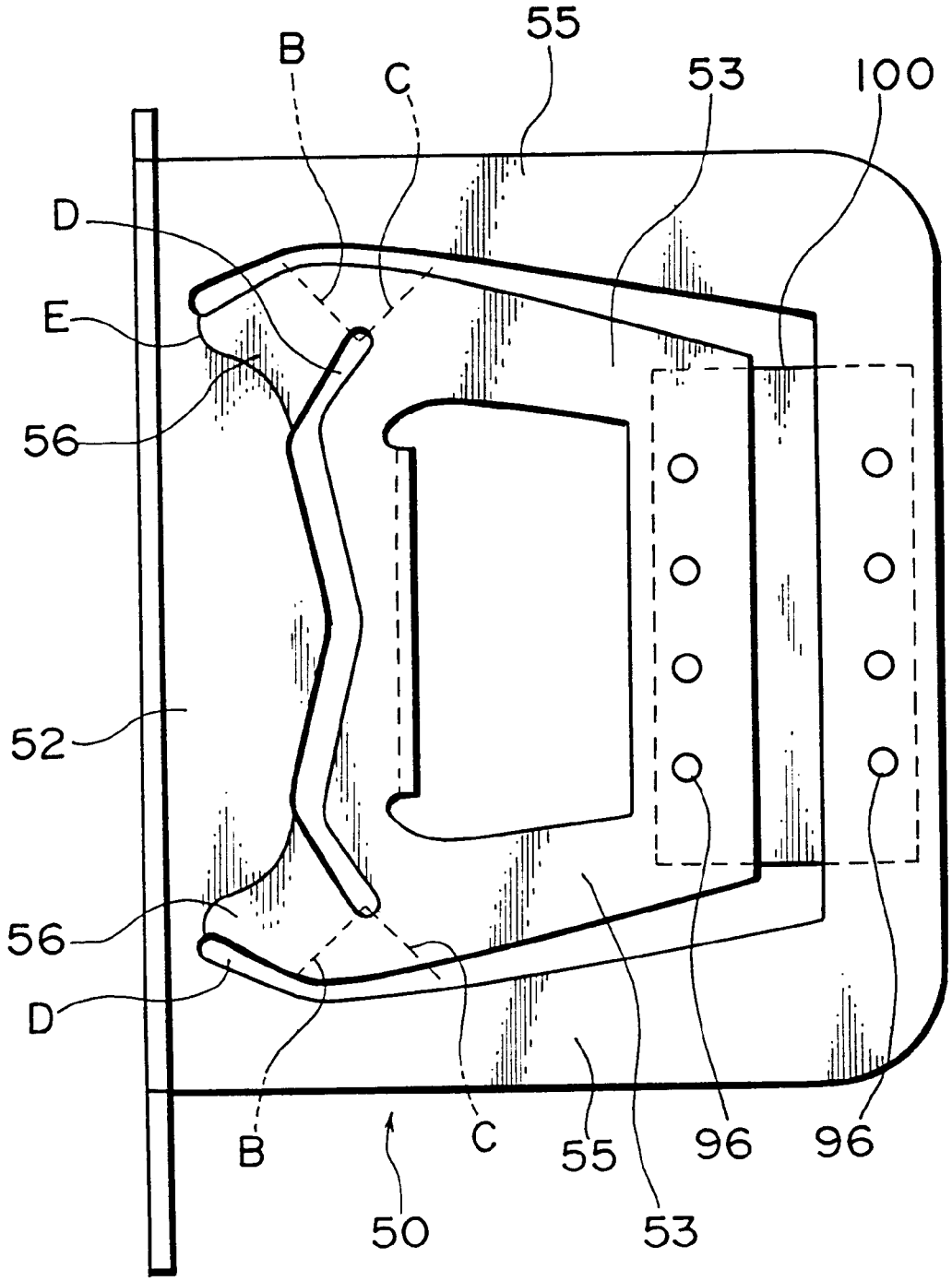
FIG. 12 is a plan view of the fifth embodiment of the present invention.

This is preferred in that the relative variabilities between the edge portions of the stationary and movable cutting blade can be minimized and also in that the cutter can be more inexpensively made with reduction of the number of components and working steps. However, the present invention is not limited to such arrangements, but may be applied to a cutter apparently formed by a plurality of components as shown in FIG. 12. This will be described in connection to such an integral cutter which is formed through a well-known techniques such as spot welding and the like.

First of all, at least the stationary and movable cutting blade forming portions are worked into the same configurations through the working process to ensure the aforementioned gap.

Thereafter, the portions of the movable cutting blade 56 other than edge portions E thereof are cut away from these forming portions. The cut portions are spot welded to a connecting portion 100 that is preferably flexible at locations 96.

Thereafter, the stationary and movable cutting blades 52 and 56 are formed at the gap by cutting the stationary and movable cutting blade forming portions at their edge portions E.

The cutting process is preferably as described. Thus, the same advantages as described can be provided.

Although the spot welding process is preferable for maintaining the flatness, strength and other factors of the cutter invariable, the present invention is not limited to such an arrangement.

Even if the stationary and movable cutting blade 52 and 56 are fastened to the connecting portion 100 through any one of the conventional pin clamping, screw fastening and other connecting techniques rather than the welding technique, the same integral structure can be provided according to the present invention.

The arrangement including a plurality of components may be provided by the first connecting portions 55 rather than the flexible portions.

The sixth embodiment of the present invention will be described in connection with FIGS. 15 to 20.

Figure 15:
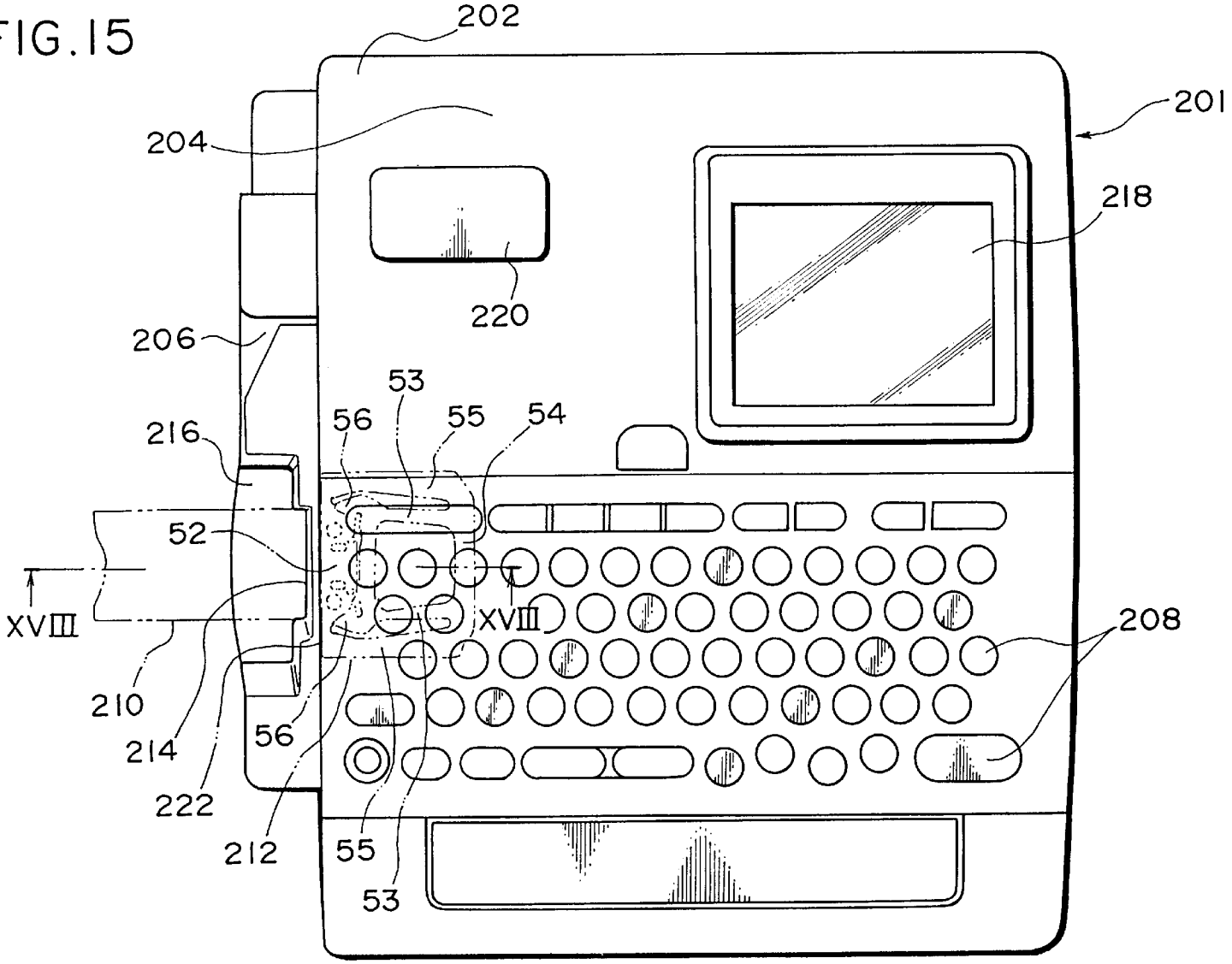
FIG. 15 is a plan view of a tape printing apparatus having a cutter which is constructed according to the sixth embodiment of the present invention.

In the sixth embodiment, the tape printing apparatus 201 comprises a casing 202 and a tape cartridge holder 204 formed therein, as shown in FIG. 15. The tape cartridge holder 204 receives a tape cartridge (not shown). After the printing step, a necessary length of rectilinearly cut tape is discharged through a tape delivery slit 206 formed in the casing 202 at one side.

Letters to be printed are selected by manipulating keybuttons 208 on a keyboard formed in the top of the casing 202. The keyboard then generates signals which are treated by a well-known electronic circuit to print the letters on the surface of the self-adhesive tape through a well-known thermal transfer printer or the like while moving the self-adhesive tape at a given speed.

The forward end corners of the self-adhesive tape 210 rectilinearly cut and discharged through the tape delivery slit 206 are cut by a cutter 212 with curvature. The cutter 212 is disposed within the casing 202 in place. The side wall of the casing 202 opposed to the cutter 212 is formed with a tape insertion slot 214. The side wall of the casing 202 is also formed with a tape guiding table 216 at a position opposed to the tape insertion slot 214.

In FIG. 15, 218 denotes an input display section; and 220 a small window formed in the tape cartridge holder 204.

Figure 17:
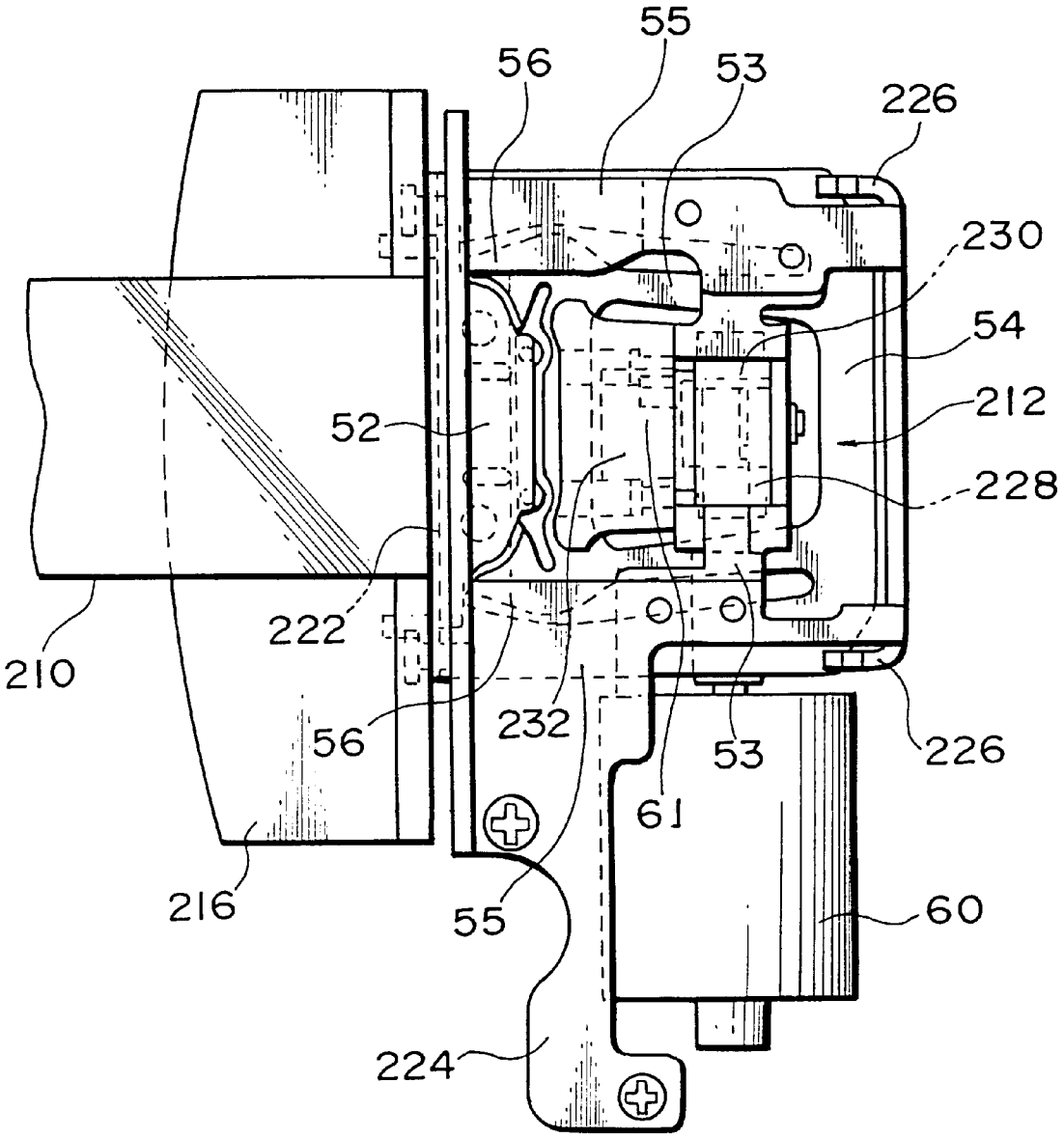
FIG. 17 is an enlarged plan view of the cutter shown in FIGS. 15 and 16.

The structure of the cutter 212 is substantially similar to that of the cutter shown in FIG. 5. As shown in FIGS. 15 and 17, the cutter includes stationary and movable cutting blades 52 and 56 which are cut and formed from a single sheet metal and disposed adjacent and opposed to each other in a plane. The stationary and movable cutting blades 52 and 56 are connected to one another to form a closed loop by a pair of first connecting portions 55 on each side of the cutter, a second connecting portion 54 connected to the first connecting portions 55 at their end and a pair of flexible portions 53 on the movable cutting blade 56 to extend from the second connecting portion 54 toward the stationary cutting blade 52.

Figure 18:
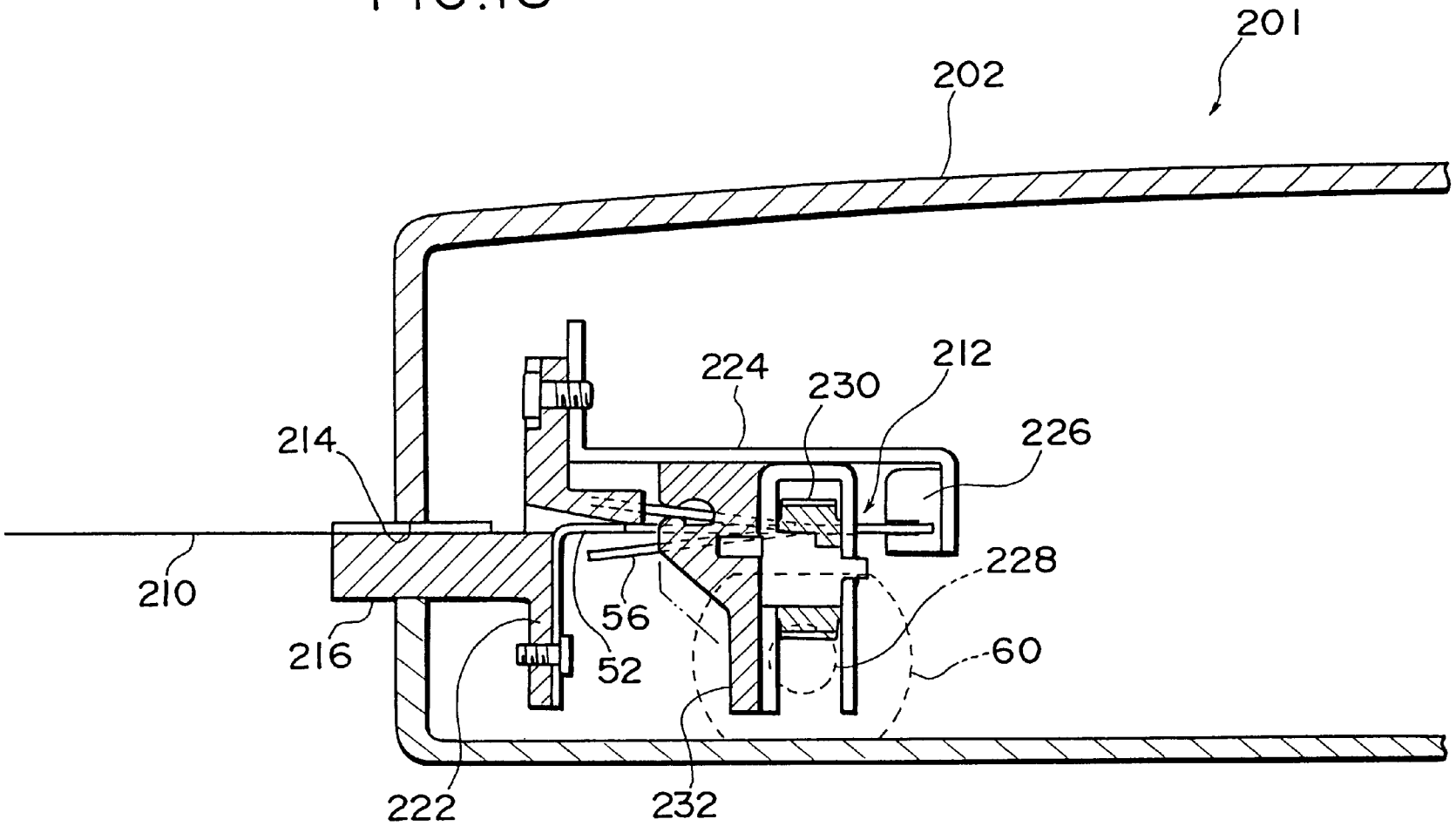
FIG. 18 is an enlarged sectional view of the cutter, taken along a line XVIII—XVIII in FIG. 15.

As shown in FIG. 18, the cutter 212 is different from the cutter of FIG. 5 in that it includes a suspended portion 222 formed by downward turning at a right angle at a position adjoining to the stationary cutting blade 52 and that the movable cutting blade 56 is bent upward relative to the stationary cutting blade 52.

The cutter 212 is supported by a holding portion 226 of a motor locking means 224 wherein the suspended portion 222 is fixedly attached to the vertical wall of the tape guiding table 216 and the second connecting portion 54 is integrally mounted on the tape guiding table 216.

Figure 16:
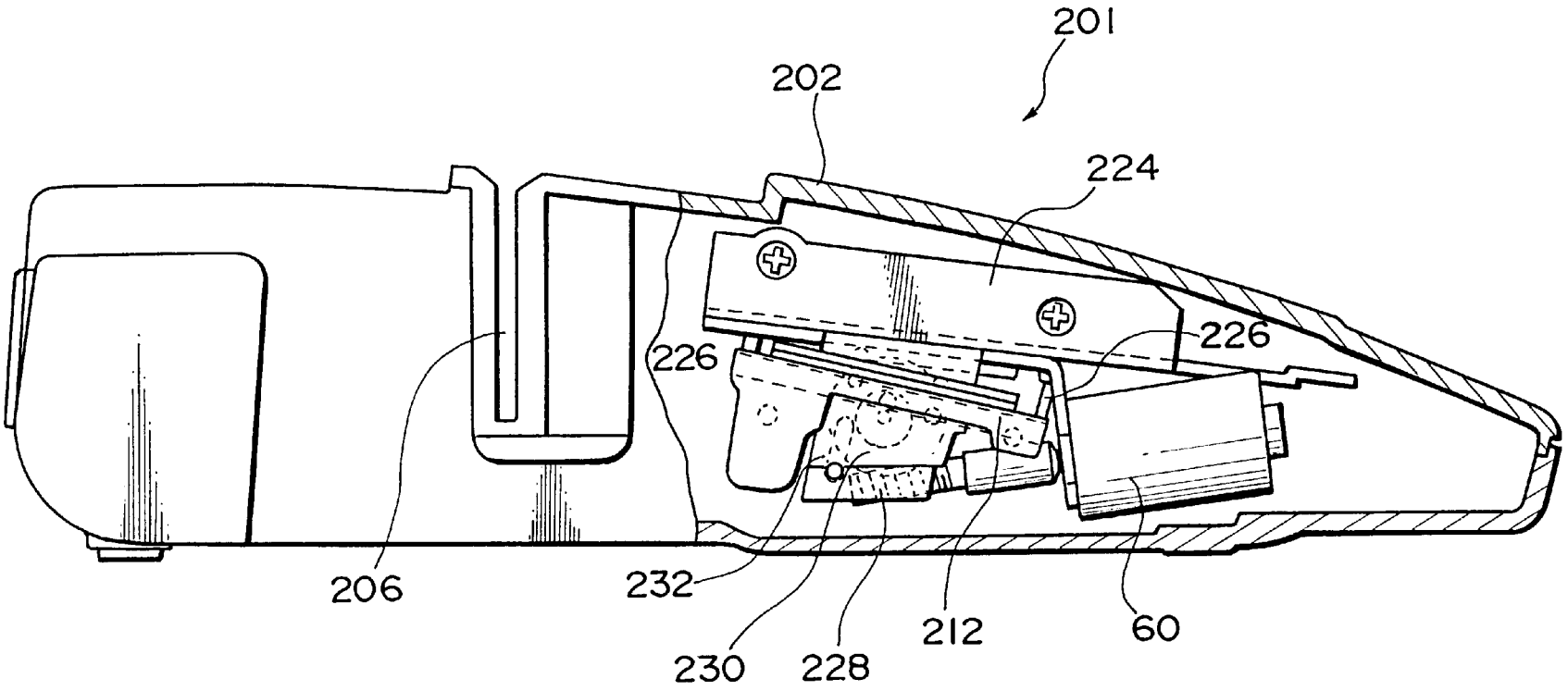
FIG. 16 is a side view, with portions broken away for clarity, of the tape printing apparatus shown in FIG. 15.

As shown in FIGS. 16 to 18, the motor locking means 224 includes a motor 60 mounted thereon in a direction perpendicular to the first connecting portions 55. The output shaft of the motor 60 is connected to a worm 228 which is in turn operatively engaged by a worm wheel 230. The worm wheel 230 includes an eccentric pin 61 which is in turn engaged by a driven means 232 to move the driven means 232 in the vertical direction. The vertical movement of the driven means 232 drives and moves the movable cutting blade 56 relative to the stationary cutting blade 52 in the vertical direction.

In such a case, the stationary cutting blade 52 will be positioned at a position facing the release paper in the self-adhesive tape 210 after it has been inserted into the tape insertion slot 214. The movable cutting blade 56 will be positioned at an upper position facing the pressure-sensitive adhesive in the self-adhesive tape 210 which is placed on the stationary cutting blade 52. When the movable cutting blade 56 is moved downward against the self-adhesive tape, a bowing or burrs can be prevented from being produced on the top face of the self-adhesive tape to improve the appearance and quality of the self-adhesive tape. On the contrary, the bowing or burrs are produced on the side of the release paper. This facilitates the release paper being stripped from the self-adhesive tape.

Figure 19:
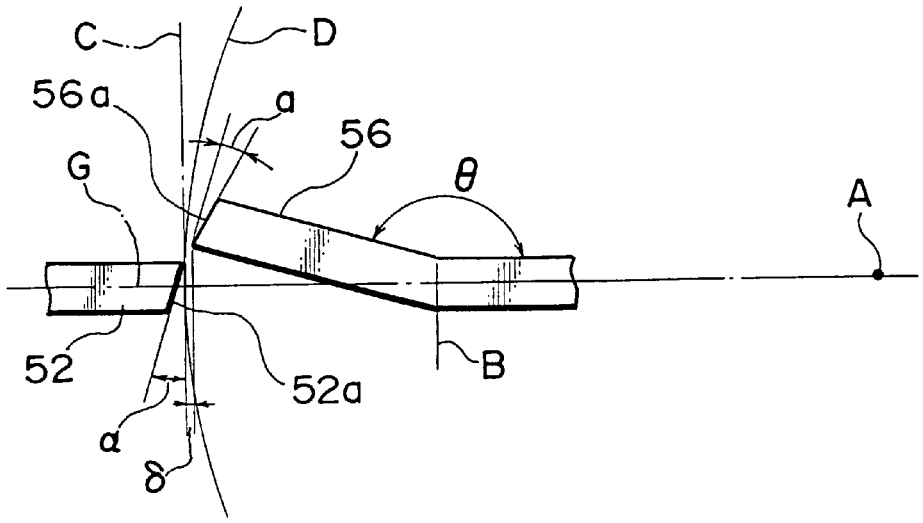
FIG. 19 is a partial enlarged view illustrating the structures of stationary and movable cutting blades.
Figure 20:
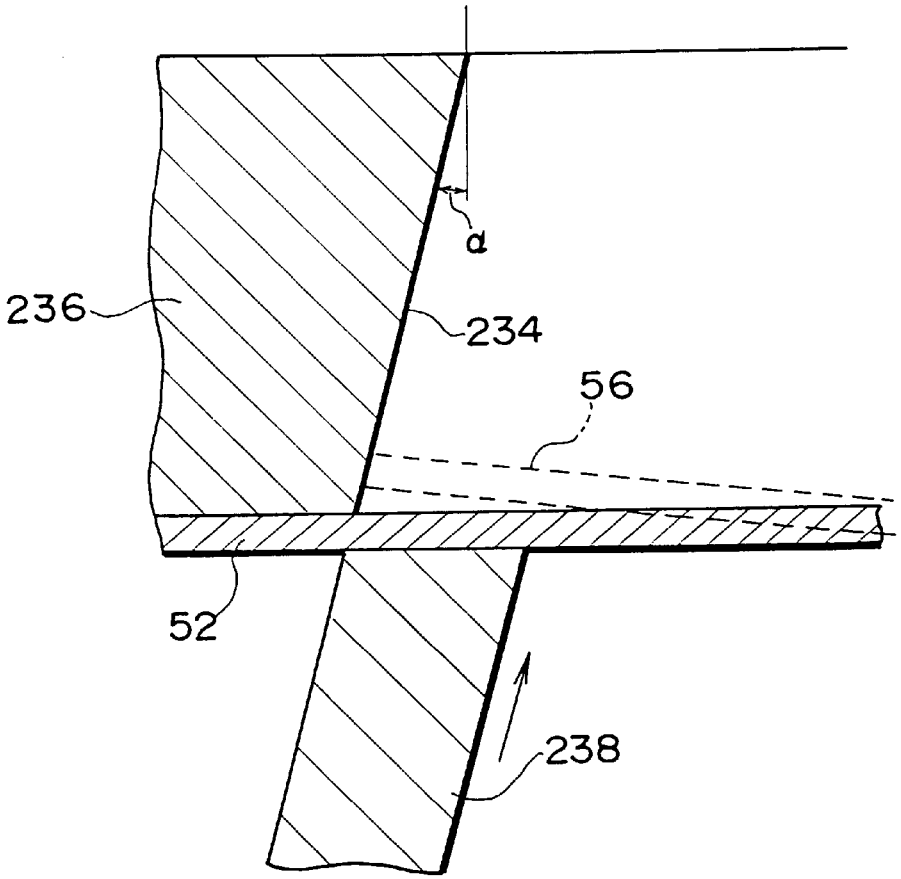
FIG. 20 is a sectional view of the stationary and movable cutting blades shown in FIG. 19 when they are in their cutting state.

As shown in FIG. 19, the swing center line A for the flexible portions 53 to swing the movable cutting blade 56 in the vertical direction is positioned nearer the movable cutting blade 56 than the cutting position C in which the self-adhesive tape 210 is cut by the stationary and movable cutting blades 52 and 56. Thus, the swing locus D of the movable cutting blade 56 is such that the movable cutting edge 56*a* hits into the stationary cutting blade 52 at the center line G in the direction of sheet thickness.

If the end faces of the stationary and movable cutting blades 52 and 56 are formed to have a relief angle $\alpha$ relative to the swing locus D, the movable cutting blade 56 can be prevented from hitting into the end face of the stationary cutting blade 52. Furthermore, an interference between the stationary cutting blade 52 and the movable cutting blade 56, which may make the cutter inoperative, can be avoided to provide a cutting process with a reduced load and with an improved efficiency.

The relief angle $\alpha$ can be easily formed in the end face of each of the stationary and movable cutting blades 52 and 56 by driving the punch 238 along a fifth slope having a wall surface 234 formed with the relief angle $\alpha$.

The relief angle $\alpha$ may be set to be equal to about three degrees, for example.

To form the first gap $\delta 1$ between the stationary and movable cutting blades 52 and 56, a given bent angle $\theta$ is formed at the line B of the movable cutting blade 56.

As described, this first gap $\delta 1$ is required in order that the second gap or overlap $\delta 2$ has a range from $-10\ \mu m$ to $50\ \mu m$ and more preferably from $-5\ \mu m$ to $10\ \mu m$. To ensure the first gap $\delta 1$, the angle $\theta$ is set to be about 15 degrees.

Although not illustrated, the aforementioned shear angle is also formed between the stationary and movable cutting blades 52 and 56.

FIGS. 21 to 25 show the seventh embodiment of the present invention.

Figure 21:
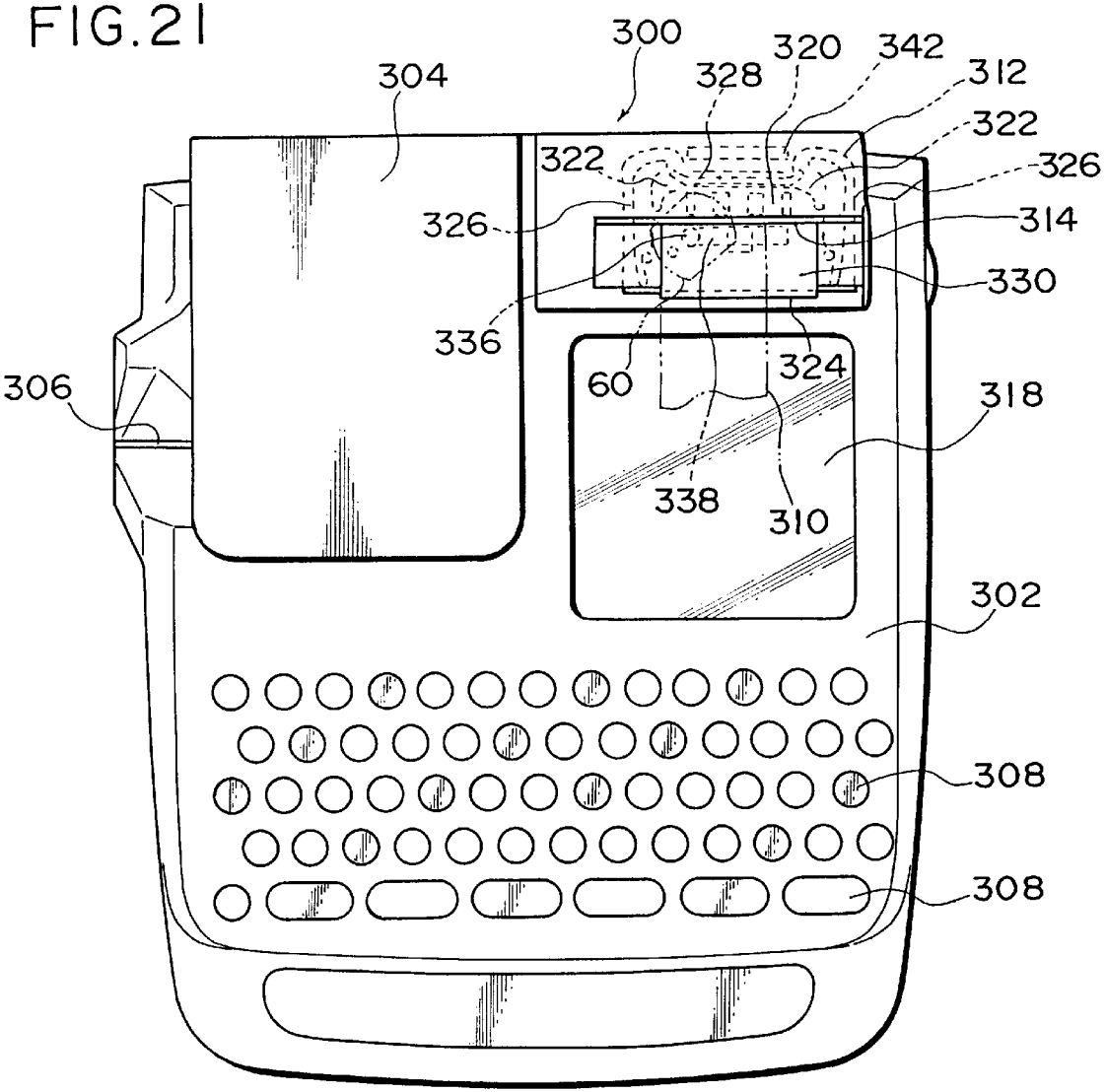
FIG. 21 is a plan view of a tape printing apparatus using a cutter which is constructed according to the seventh embodiment of the present invention.

As shown in FIG. 21, a tape printing apparatus 300 comprises a casing 302 and a tape cartridge holder 304 formed therein. Letters inputted through keybuttons 308 are displayed on an input display section 318. The displayed letters are printed on the surface of self-adhesive tape 310 in the tape cartridge holder 304. The self-adhesive tape 310 is rectilinearly cut at one end and discharged through a tape delivery slit 306.

The forward end corners of the self-adhesive tape 310 discharged through the tape delivery slit 306 is then inserted into a tape insertion slot 314 formed in the casing behind the input display section 318. The inserted end of the self-adhesive tape 310 is then cut with curvature by a cutter 312 which is disposed in the casing 202 at a position opposed to the tape insertion slot 314.

Figure 24:
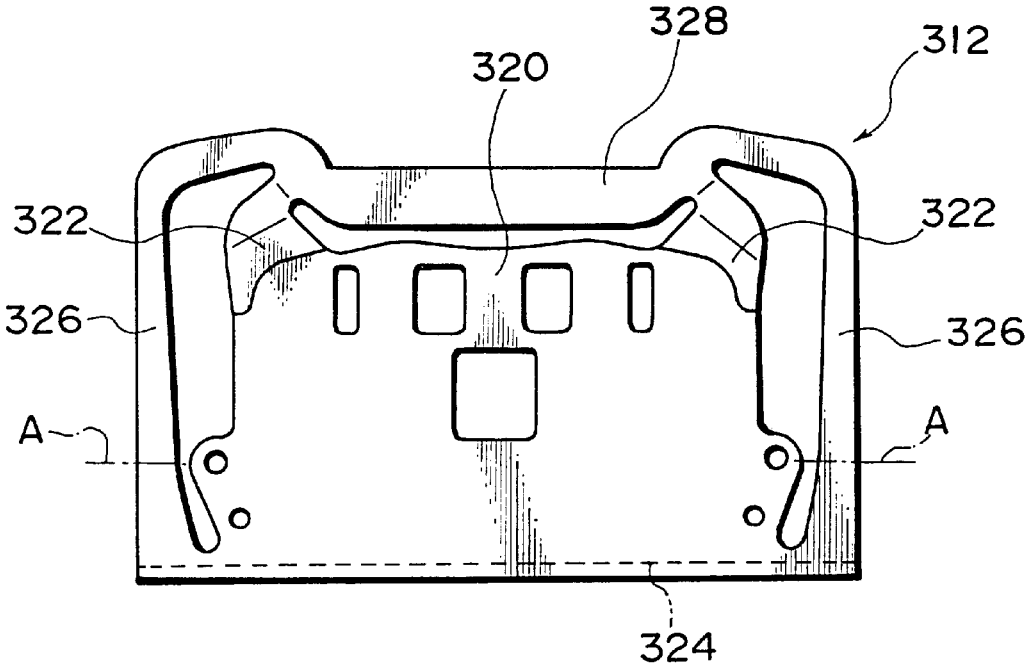
FIG. 24 is a plan view of the cutter shown in FIGS. 21 to 23.

As shown in FIG. 24, the cutter 312 comprises stationary and movable cutting blades 320 and 322 which are formed from a sheet metal and disposed adjacent to each other in a plane. The base portion of the stationary cutting blade 320 has a suspended portion 324 turned downward from the stationary cutting blade 320 at a right angle. A pair of connecting portions 326 extend backward from outer sides of the suspended portion 324 substantially at a right angle along the outer sides of the stationary cutting blade 320. The backward end of the connecting portions 326 form a closed loop with the movable cutting blades 322. The pair of connecting portions 326 are connected to each other through a connection 328.

Figure 26:
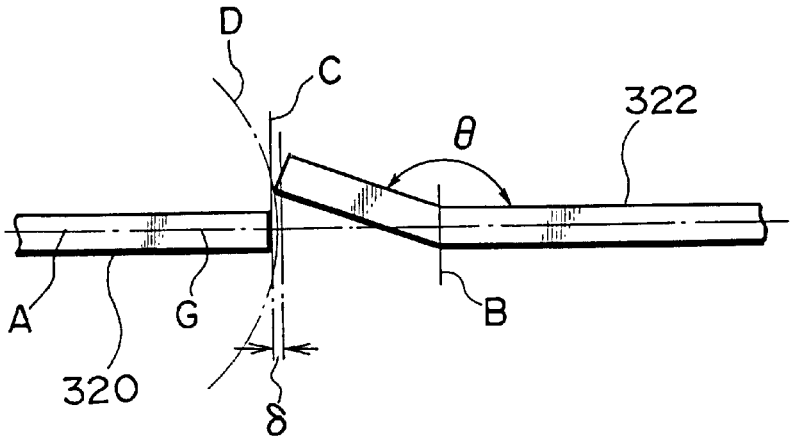
FIG. 26 is an enlarged view illustrating the structures of stationary and movable cutting blades of the present invention.

As shown in FIG. 26, the connecting portions 326 also include flexible portions. The flexible portions define a swing center line A on the left side of the cutting position C in which the self-adhesive tape 310 is cut by the stationary and movable cutting blades 320 and 322, as shown in FIG. 26. The movable cutting blade 322 swings around the swing center line A. The distance between the swing locus D of the movable cutting blade 322 and the stationary cutting blade 320 becomes longest when the swing locus D is on the center line G in the direction of sheet thickness of the stationary cutting blade 320.

Therefore, the movable cutting blades 322 will not hit into the stationary cutting blade 320 when they are rotated. Furthermore, the movable cutting blades 322 will not interfere with the stationary cutting blade 320 to make the cutter inoperative. Thus, the cutting may be carried out with a reduced load and with an improved efficiency.

For such a reason, the end faces of the stationary and movable cutting blades 320 and 322 do not require any relief angle for avoiding the interference with the swing locus of the movable cutting blades 322 as shown in FIG. 19. The movable cutting blades 322 may be only bent at the line B with a given angle θ to form the gap δ between the stationary and movable cutting blades 320 and 322. Thus, the stationary and movable cutting blades 320 and 322 can be more easily formed.

Figure 22:
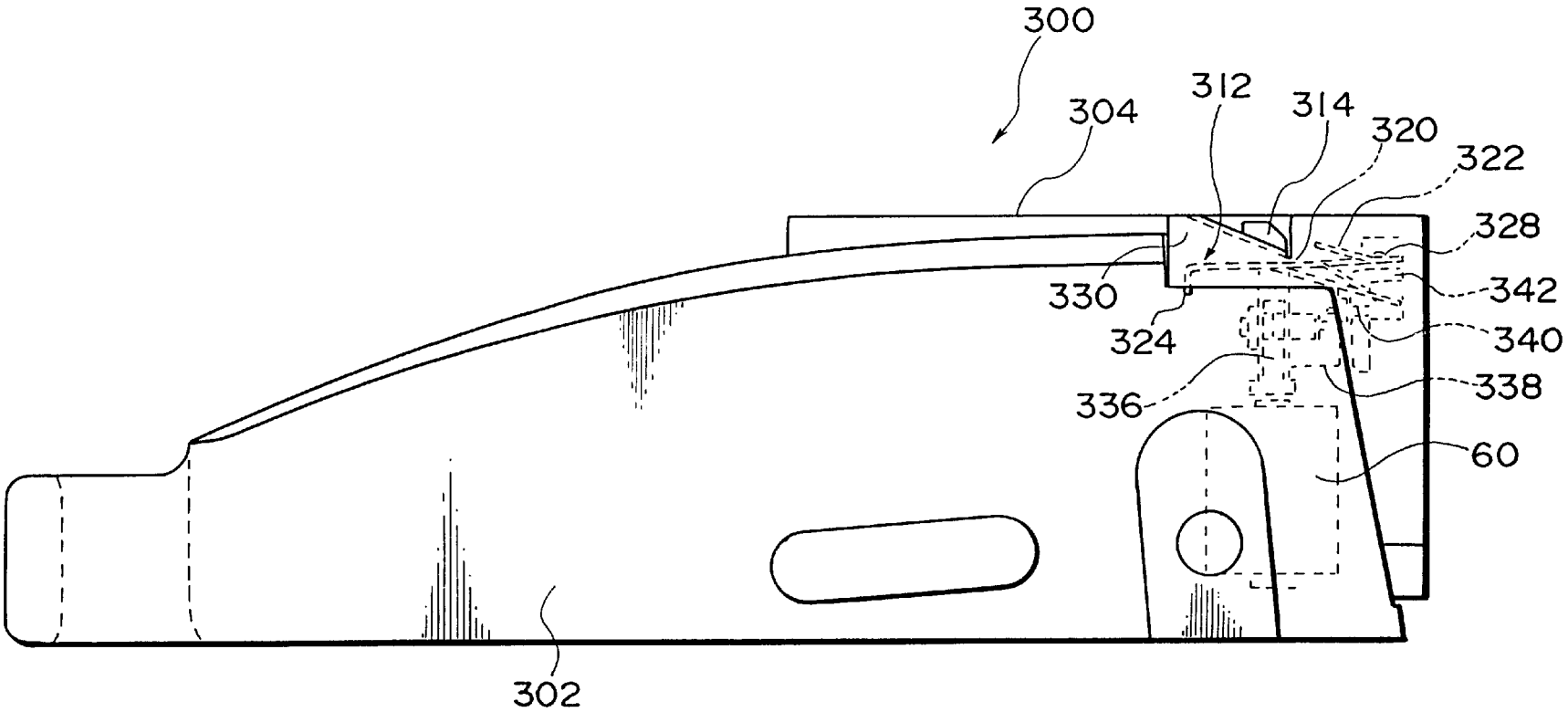
FIG. 22 is a left side view of the tape printing apparatus shown in FIG. 21.
Figure 23:
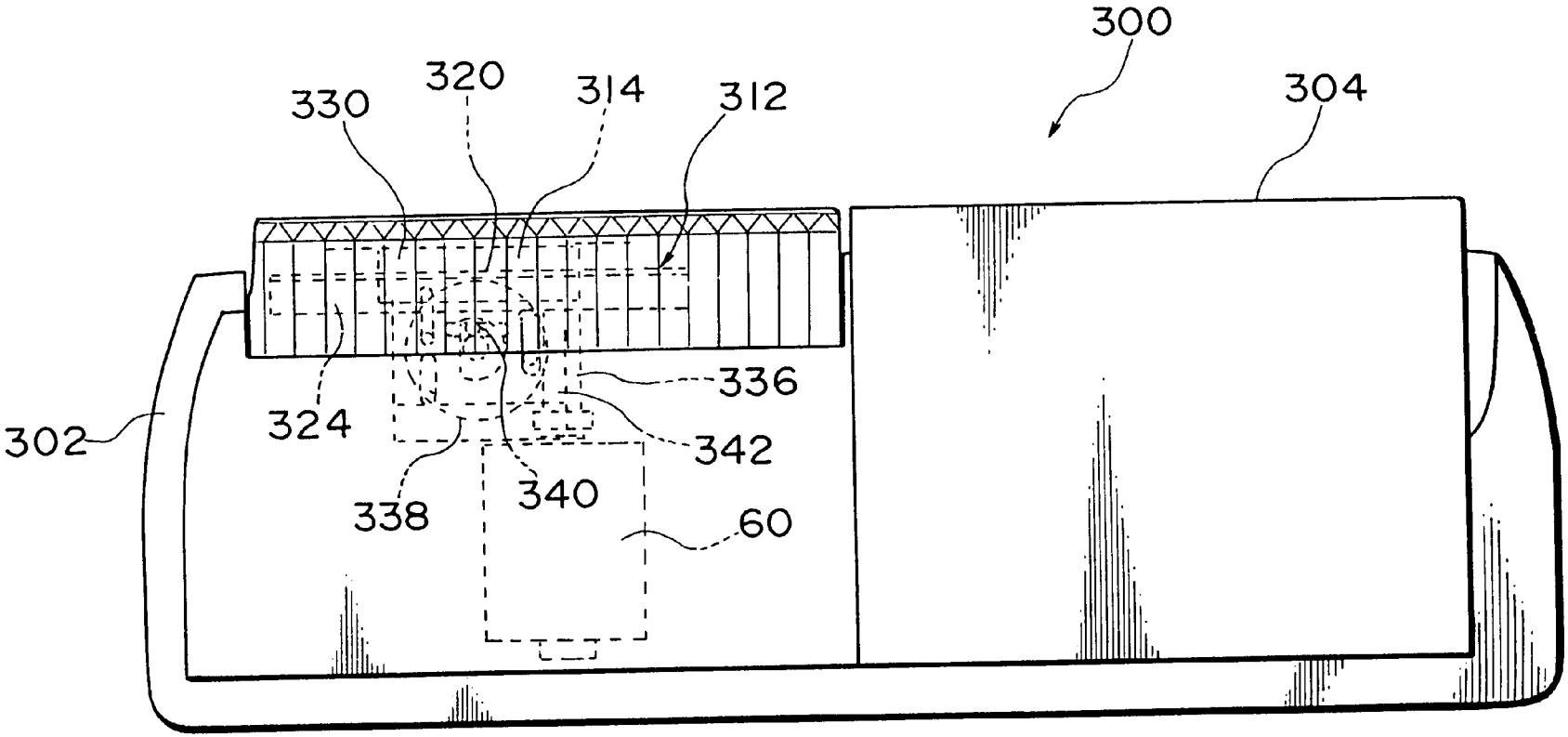
FIG. 23 is a back view of the tape printing apparatus shown in FIGS. 21 and 22.

As shown in FIGS. 21 to 23, the cutter 312 is mounted on a tape guiding table 330. The stationary cutting blade 320 is disposed at a position facing the release paper of the self-adhesive tape 310 after it has been inserted through the tape guiding table 330. The movable cutting blades 322 are disposed at a position facing the base sheet of the self-adhesive tape 310 placed on the stationary cutting blade 320. When the movable cutting blades 322 are driven toward the self-adhesive tape, the latter will be cut with curvature.

Therefore, the seventh embodiment can also avoid any bowing created on the top face of the self-adhesive tape when it is being cut and provide a better appearance and improved quality in the opposite face of the cut self-adhesive tape, as previously described. In addition, a bowing will be created on the side of the release paper in the self-adhesive tape to facilitate the release paper being stripped from the self-adhesive tape.

Figure 25:
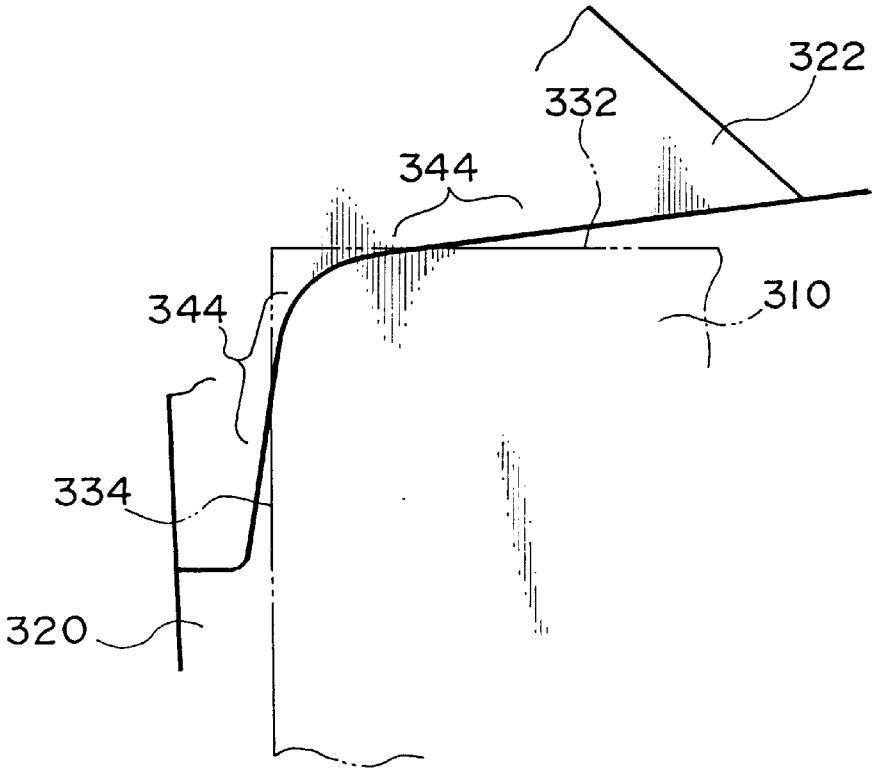
FIG. 25 is a plan view of the stationary and movable cutting blades of the present invention in their cutting state.

As shown in FIG. 25, the stationary and movable cutting blades 320 and 322 are curved to round the inserted end of the self-adhesive tape 310. The curved configuration includes a substantially rectilinear section that is formed adjacent a position 344 contacting two intersecting sides 332 and 334 in the end corners of the inserted self-adhesive tape 310 and has a small angle formed between these two sides 332 and 334.

When the stationary and movable cutting blades 320 and 322 are formed in the above manner and even if the self-adhesive tape 310 is inserted with a deviation from one of the left and right sides, such a rectilinear section enables the cutter to cut the self-adhesive tape in a proper manner without great difference between the left and right side corners of the inserted tape end.

In such a cutter 312, the movable cutting blades 322 are driven by an upstanding motor 60 disposed below the stationary cutting blade 320 in the vertically direction through a worm 336, a worm wheel 338, a pin 340 formed in the worm wheel 338 and a vertically driven means by the pin 340 via a connection 328 connected to the driven means 342.

When the pair of connecting portions 326 form a closed loop, the cutter can be provided which is increased in rigidity and improved in durability and stability.

The seventh embodiment can be not only simplified in construction, but also reduced in size from the edge portions E to the backward end, compared with the structure of FIG. 5 wherein the connecting portions are formed separately from the flexible portions. This also make the cutter compact.

In the above structure of the cutter 312, the cutting force is counteracted mainly by a tensile stress created in the connecting portions 326 and a buckling stress created in the stationary cutting blade 320 when the self-adhesive tape is cut by the stationary and movable cutting blades 320 and 322. In addition, the cutter has a strength sufficient to withstand the tensile and buckling stresses. Such a strength can sufficiently counteract the cutting force.

Figure 27:
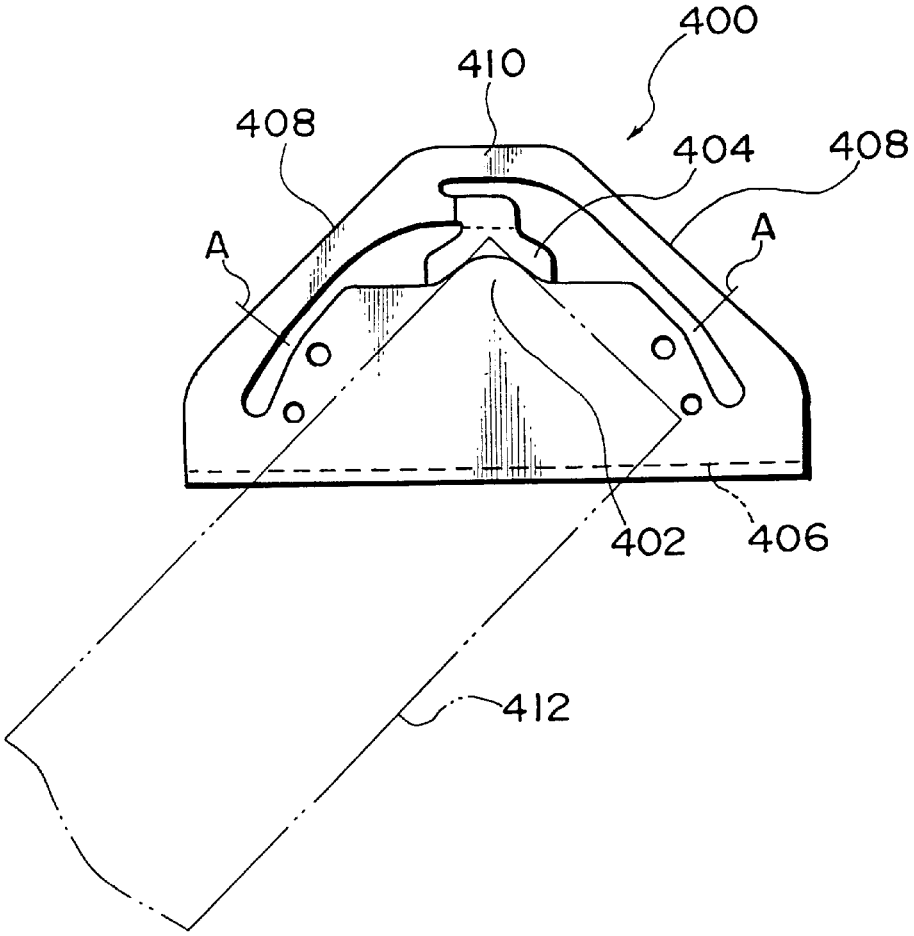
FIG. 27 is a plan view of a cutter constructed according to the eighth embodiment of the present invention.

FIG. 27 shows a cutter according to the eighth embodiment of the present invention.

A cutter 400 comprises a stationary cutting blade 402 and a movable cutting blade 404, which blades are formed from a flat plate-shaped sheet metal and disposed adjacent and opposed to each other in a plane. The cutter also comprises a suspended portion 406 formed by turning a sheet metal portion adjoining to the stationary cutting blade 402 at a right angle and a pair of connecting portions 408 formed to extend from the suspended portion backwardly along each side of the movable cutting blade 404 while approaching each other and connected to the movable cutting blade 404, the suspended and connecting portions 406 and 408 defining a closed loop together.

The pair of connecting portions 408 are connected at the backward end to each other through a connection 410.

The pair of connecting portions 408 includes flexible portions formed on parts of the connecting portions 408 and can be flexed at the swing center line A which provides a flexion point for the stationary cutting blade 402, rather than the cutting position wherein the self-adhesive tape 412 is cut by the stationary and movable cutting blade 402 and 404.

When the self-adhesive tape 412 is slantly inserted into the cutter with one corner of the end of the self-adhesive tape 412 being placed between the stationary and movable cutting blade 402 and 404 and when the movable cutting blade 404 is moved, that one corner will be cut with a curvature. Thereafter, the other corner is similarly cut with the same curvature by the stationary and movable cutting blade 402 and 404.

Thus, the structure of the cutter 400 can be more simplified and more easily and inexpensively manufactured.

The cutter 400 is different from the cutter of the seventh embodiment only in that a single movable cutting blade 404 is provided for the stationary cutting blade 402. The other construction and function of the cutter 400 are similar to those of the seventh embodiment, but will not further be described.

What is claimed is:

1. A cutter for cutting a member, said cutter comprising:

a stationary cutting blade having at least two stationary cutting edges separated from each other by a non-cutting portion and generally symmetrical to each other in shape, an imaginary transverse line extending from a center of a first one of said at least two stationary cutting edges to a center of a second one of said at least two stationary cutting edges;

a movable cutting blade having at least two movable cutting edges which move along a locus including a position opposed to said stationary cutting edges, said at least two movable cutting edges being separated from each other by a non-cutting portion and generally symmetrical to each other in shape; and a pair of connecting means for connecting said stationary cutting blade with said movable cutting blade, said pair of connecting means having flexible means for flexibly supporting said movable cutting blade relative to said stationary cutting blade;

wherein a closed loop is formed by said stationary and movable cutting blades and said pair of connecting means, and wherein each of said stationary and movable cutting edges has first and second straight cutting portions connected by a curved cutting portion, the first straight cutting portions of said stationary and movable cutting edges extend at an small angle close to being parallel to said imaginary transverse line, and the second straight cutting portions of the stationary and movable cutting edges extend at a small angle close to being perpendicular to said imaginary transverse line.

2. The cutter as defined in claim 1, wherein said stationary cutting blade includes a base portion and a free end portion having said stationary cutting edges at an opposite side of said base portion.

3. The cutter as defined in claim 2, wherein said pair of connecting means extend in a direction perpendicular to said base portion of said stationary cutting blade.

4. The cutter as defined in claim 3, wherein said pair of connecting means have tensile strength which counteracts tensile stress which acts on said pair of connecting means on cutting operation.

5. The cutter as defined in claim 3, wherein said stationary cutting blade has buckling strength which counteracts buckling stress which acts on said stationary cutting blade on cutting operation.

6. The cutter as defined in claim 3, wherein said pair of connecting means comprising:

a pair of first connecting means having one end and another ends, said one end being connected to said base portion of said stationary cutting blade; and second connecting means for connecting said another ends of said pair of first connecting means;

wherein a pair of said flexible means are disposed inside of said pair of first connecting means substantially parallel to said pair of first connecting means, said flexible means being connected to said second connecting means and said movable cutting blade.

7. The cutter as defined in claim 6, wherein said flexible portions has a swing center on the side of said movable cutting blade, rather than a cutting position between said stationary cutting edges and said movable cutting edge.

8. The cutter as defined in claim 6, wherein said pair of connecting means have tensile strength which counteracts tensile stress which acts on said pair of connecting means on cutting operation; and wherein said stationary cutting blade has buckling strength which counteracts buckling stress which acts on said stationary cutting blade on cutting operation.

9. The cutter as defined in claim 1, further comprising driving means for driving said movable cutting blade and driven means driven by said driving means, said driven means being disposed on part of said movable cutting blade between said pair of connecting means.

10. The cutter as defined in claim 9, wherein said driven means is disposed at a position adjacent to said movable cutting edges.

11. The cutter as defined in claim 1, wherein said member further comprises self-adhesive tape with release paper; and wherein said movable cutting blade is disposed at a position facing said self-adhesive tape and said stationary cutting blade is disposed at a position facing said release paper.

12. The cutter as defined in claim 1, wherein one of said stationary cutting edges is inclined relative to the other of said movable cutting edges.

13. The cutter as defined in claim 1, wherein at least one of the movable cutting blade, flexible means and stationary cutting blade is bent to provide a first gap between said stationary and movable cutting edges; and wherein a bending position for providing said first gap is different from a swing center of said flexible means for swinging said movable cutting blade.

14. The cutter as defined in claim 13, wherein a second gap or overlap between said stationary and movable cutting edges is set between $-10\ \mu m$ and $50\ \mu m$, said second gap or overlap being created on a cutting operation when said movable cutting edges move to a position opposed to said stationary cutting edges.

15. The cutter as defined in claim 14, wherein said second gap or overlap is set between $-5\ \mu m$ and $10\ \mu m$.

16. The cutter as defined in claim 1 wherein said pair of connecting means comprise:

first connecting means connected to said stationary cutting blade to form a first closed loop; and a plurality of flexible means connected to said movable cutting blade, wherein said flexible means and a part of said first closed loop form a second closed loop inside said first closed loop.

* * * * *

UNITED STATES PATENT AND TRADEMARK OFFICE

CERTIFICATE OF CORRECTION

PATENT NO : 6,116,132

DATED : September 12, 2000

INVENTOR(S): Noriyuki KAMIJO

It is certified that error appears in the above-identified patent and that said Letters Patent are hereby corrected as shown below:

Col. 1, line 73, after "Corporation," and before "Tokyo" insert – "and KING JIM CO., LTD.".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*